US008270883B2

(12) United States Patent
Ozawa et al.

(10) Patent No.: US 8,270,883 B2
(45) Date of Patent: Sep. 18, 2012

(54) POWDER CARRYING APPARATUS AND IMAGE FORMING APPARATUS

(75) Inventors: Hideaki Ozawa, Ebina (JP); Yoshiyuki Takashima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 317 days.

(21) Appl. No.: 12/781,022

(22) Filed: May 17, 2010

(65) Prior Publication Data

US 2011/0123231 A1 May 26, 2011

(30) Foreign Application Priority Data

Nov. 20, 2009 (JP) ..... 2009-265717

(51) Int. Cl.
*G03G 15/08* (2006.01)

(52) U.S. Cl. ..... 399/263; 399/258

(58) Field of Classification Search ..... 399/224, 399/228, 258, 260, 262, 263
See application file for complete search history.

(56) References Cited

U.S. PATENT DOCUMENTS 5,828,934 A * 10/1998 Tamura et al. ..... 399/228
6,292,641 B1 * 9/2001 Takeyama et al. ..... 399/228
7,447,460 B2 * 11/2008 Tsuchihashi et al. ..... 399/88
2006/0165423 A1 7/2006 Nishitani et al.

FOREIGN PATENT DOCUMENTS

JP 3060562 U 6/1999
JP 2006-201314 A 8/2006

* cited by examiner

*Primary Examiner* — David Gray
*Assistant Examiner* — Gregory H Curran
(74) *Attorney, Agent, or Firm* — Sughrue Mion, PLLC

(57) ABSTRACT

A powder carrying apparatus includes: a drive gear to which the drive is carried from a drive source; a rolling gear capable of rotating around a rolling shaft; a first middle transmission system having at least one or more gears; a first powder carrying member to which the rotation is carried from the first middle transmission system to carry the powder; a first regulating gear capable of rotating around a first regulation shaft; a second middle transmission system having at least one or more gears including a second middle gear engaged with the rolling gear; a second powder carrying member to which the rotation is carried from the second middle transmission system to carry the powder; and a second regulating gear capable of rotating around a second regulation shaft.

8 Claims, 16 Drawing Sheets

POWDER CARRYING APPARATUS AND IMAGE FORMING APPARATUS

CROSS-REFERENCE TO RELATED APPLICATION

This application is based on and claims priority under 35 USC 119 from Japanese Patent Application No. 2009-265717 filed on Nov. 20, 2009.

BACKGROUND

Technical Field

The present invention relates to a powder carrying apparatus and an image forming apparatus.

SUMMARY

According to an aspect of the invention, a powder carrying apparatus includes a driving gear to which the drive is carried from a drive source capable of rotating positive and negative;

a rocking gear capable of rotating around a rolling shaft which is movably supported along a rocking guide portion installed in a frame, wherein the rocking gear is engaged with the driving gear, when the drive source rotates positive, the rocking gear is moved to a prescribed first rocking position along the rocking guide portion, and when the drive source rotates negative, the rocking gear is moved to a second rocking position different from the first rocking position along the rocking guide portion;

a first intermediate transmission system having at least one or more gears including a first intermediate gear engaged with the rocking gear that has been moved to the first rocking position;

a first powder carrying member to which the rotation is carried from the first intermediate transmission system to carrying the powder;

a first regulating gear capable of rotating around a first regulating shaft which is movably supported along a first regulating guide portion installed in the frame, wherein when the drive source rotates positive, the first regulating gear is moved to a first release position separated from the first fixing teeth installed in the frame, and when a force in a direction in which the drive source rotates negative acts on the first powder carrying member, the first regulating gear is moved to a first regulating position in which the first regulating gear is engaged with the first fixing teeth to regulate the rotation of the first intermediate gear;

a second intermediate transmission system having at least one or more gears including a second intermediate gear engaged with the rocking gear that has been moved to the second rocking position;

a second powder carrying member to which the rotation is carried from the second intermediate transmission system to carry the powder; and a second regulating gear capable of rotating around a second regulating shaft which is movably supported along a second regulating guide portion installed in the frame, wherein when the drive source rotates negative, the second regulating gear is moved to a second release position separated from the second fixing teeth installed in the frame, and when a force in a direction in which the drive source rotates positive acts on the second powder carrying member, the second regulating gear is moved to a second regulating position in which the second regulating gear is engaged with the second fixing teeth to regulate the rotation of the second intermediate gear.

BRIEF DESCRIPTION OF THE DRAWINGS

Embodiments of the invention will be described in detail based on the following figures, wherein:

FIGS. 10A-10B are enlarged views of principal parts of a rolling gear of the first embodiment, wherein FIG. 10A is a diagram of a state in which a first rolling gear moves to a first rocking position, and FIG. 10B is a diagram of a state in which the first rolling gear moves to a second rocking position, FIGS. 11A-11B are enlarged views of principal parts of a first regulating gear of the first embodiment, wherein FIG. 11A is a diagram of a state in which the first regulating gear has moved to a first release position, and FIG. 11B is a diagram of a state in which the first regulating gear has moved to a first regulation position, FIGS. 12A-12C are diagrams of principal parts in a driving system of the related art, wherein FIG. 12A is a diagram in a state in which a drive gear is driven for positive rotation, FIG. 12B is a diagram of a state in which the drive gear of FIG. 12A is stopped, and FIG. 12C is a diagram of a state in which a force for negative rotation is applied by a resilient restoring force of an agitator, FIGS. 13A-13B are diagrams of principal parts of a regulation guide portion, wherein FIG. 13A is a diagram of principal parts of a first regulation guide portion of the first embodiment, and 13B is a diagram of an arc-shaped regulation guide portion with a protrusion on the upper part thereof, FIGS. 14A-14B are diagrams of principal parts of a regulation guide portion, wherein FIG. 14A is diagram of principal parts of a regulation guide portion with a shape of a long hole in an up and down direction, and FIG. 14B is a diagram of principal parts of an inclined regulation guide portion, FIGS. 15A-15B are diagrams of principal parts of a regulation guide portion, wherein FIG. 15A is a diagram of principal parts of a regulation guide portion which is disposed on a lower part of a regulated gear, and FIG. 15B is a diagram of principal parts of a first regulation guide portion of the first embodiment.

DETAILED DESCRIPTION

Figure 1:
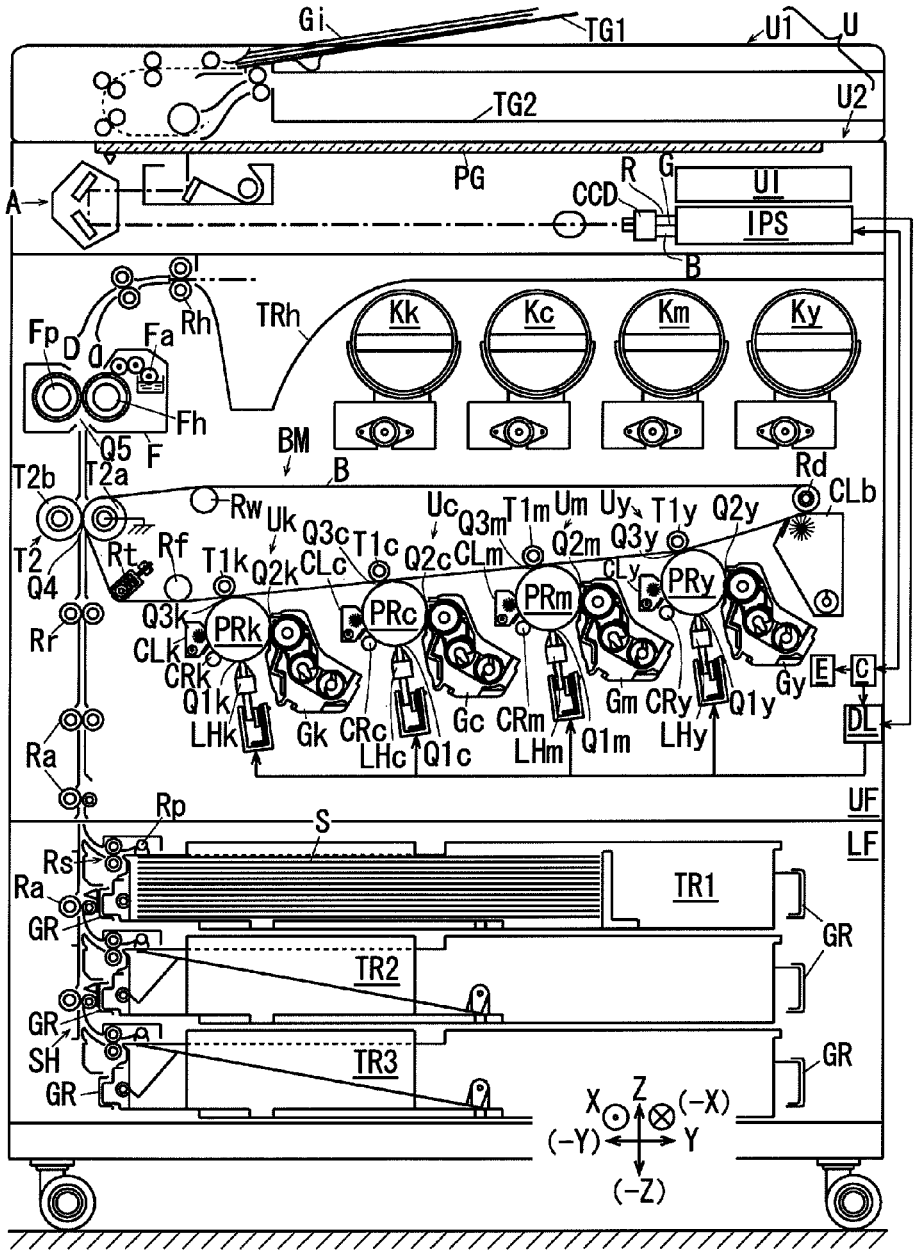
FIG. 1 is an overall diagram of an image forming apparatus of a first embodiment of the present invention.

While specific examples (embodiments) of the present invention will be described hereinafter with reference to the drawings, the present invention is not limited to the embodiments as described hereinafter.

Furthermore, in order to facilitate the understanding of the following description, it is assumed that, in the drawings, a front and rear direction is an X-axis direction, a left and right direction is a Y-axis direction, an up and down direction is a Z-axis direction, and directions and sides shown by arrows X, −X, Y, −Y, Z and −Z indicate a front part, a rear part, a right part, a left part, an upper part and a lower part or a front side, a rear side, a right side, a left side, an upper side and a lower side, respectively.

In addition, in the drawings, where "•" appears in "O" in the drawings refers to an arrow pointing from the rear of a paper to a front thereof, and where "x" is described in "O" in the drawings refers to an arrow pointing from the front of the paper to the rear thereof.

Furthermore, in the following description based on the drawings, the showing of members other than those necessary for explanation is omitted as appropriate to facilitate the understanding.

Embodiment 1

FIG. 1 is an overall diagram of an image forming apparatus of a first embodiment of the present invention.

In FIG. 1, an image forming apparatus U includes an automatic document feeding apparatus U1, and an image forming apparatus main body U2 that supports the automatic document feeding apparatus U1 and has a feeding document scanning surface PG on an upper end thereof.

The automatic document feeding apparatus U1 has a document feeding portion TG1 in which a plural documents Gi to be copied is overlapped and accommodated, and a document discharging portion TG2 to which the document Gi, which is supplied from the document feeding portion TG1 and is fed through a document scanning position on the document scanning surface PG, is discharged.

The image forming apparatus main body U2 has an operation portion U1 into which a user inputs a working command signal such as an image forming operation start, and a light exposing optical system A or the like.

The reflection light from the document, which is transported on the document scanning surface PG by the automatic document feeding apparatus U1, or the document, which is manually placed on the document scanning surface PG, is converted to electrical signals of red: R, green: G and blue: B by a solid state imaging element CCD via the light exposing optical system A.

An image information conversion portion IPS converts the electrical signals of the RGB, which are input from the solid state imaging element CCD, to image information of black K, yellow: Y, Magenta: M and cyan: C and temporarily stores the same, and outputs the image information to a latent image forming apparatus drive circuit DL as image information for forming latent image at a predetermined time.

Furthermore, when a document image is a single color image, so-called monochrome, image information of only black K is input into a latent image forming apparatus drive circuit DL.

The latent image forming apparatus drive circuit DL has each drive circuit of each color Y, M, C and K (not shown), and outputs the signals according to the output image information to latent image forming apparatuses LHy, LHm, LHc, and LHk disposed for each color at a predetermined time.

Figure 2:
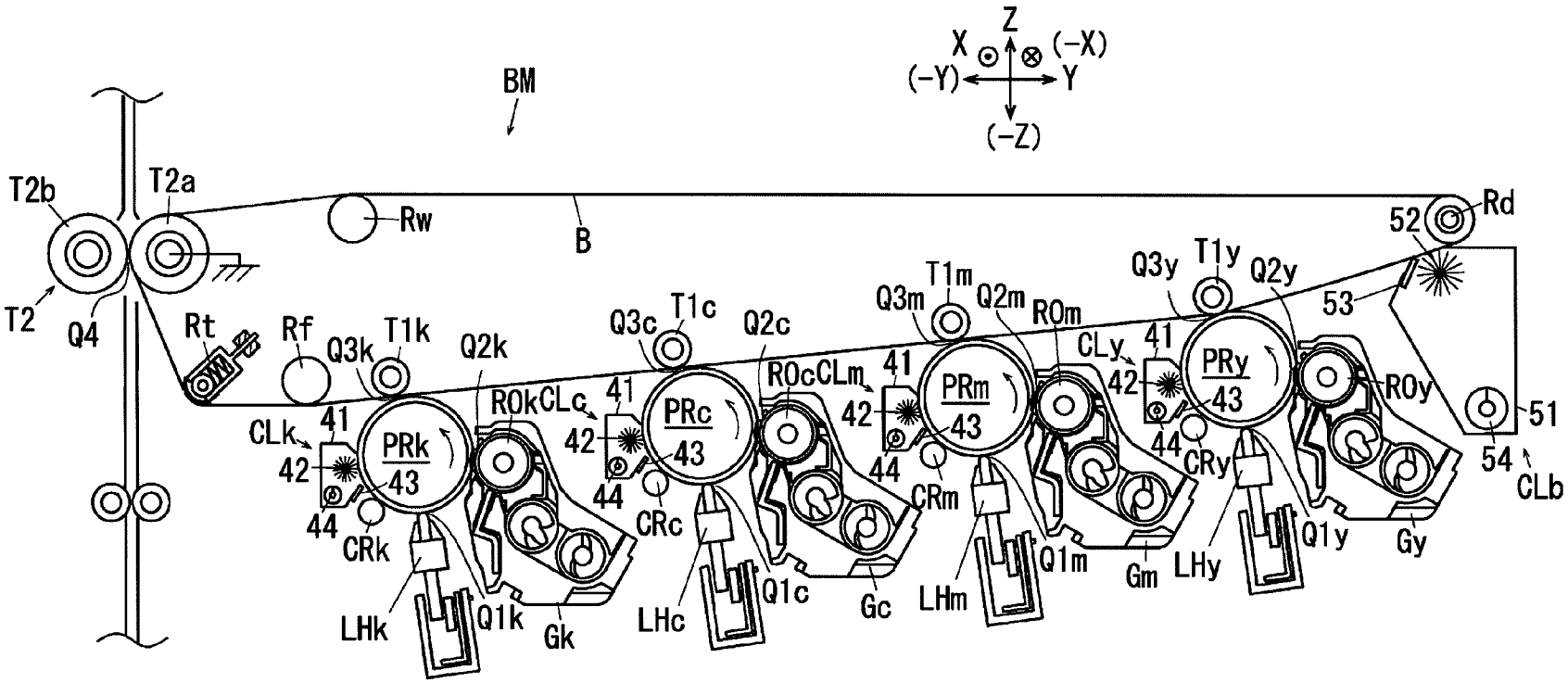
FIG. 2 is an enlarged view of principal parts of the image forming apparatus of the first embodiment.

FIG. 2 is an enlarged diagram of principal parts of an image forming apparatus of the first embodiment.

Visible image forming apparatuses Uy, Um, Uc and Uk disposed at a center portion in a gravitational direction of the image forming apparatus U are apparatuses that form visible images of each color of Y, M, C and K.

Latent image recording lights of Y, M, C and K, which are emitted from each of the latent image recording light sources of the latent image forming apparatuses LHy to LHk, are incident into photoreceptors PRy, PRm, PRc and PRk as one example of rotating image holders, respectively. Furthermore, in embodiment 1, the latent image forming apparatuses LHy to LHk are constituted by a so-called LED array.

The Y visible image forming apparatus Uy has a rotating photoreceptor PRy, a charger CRy, the latent image forming apparatus LHy, a developing apparatus Gy, a transfer roller T1*y* as one example of a transfer unit, and an image holder cleaner CLy. Furthermore, in embodiment 1, the photoreceptor PRy, the charger CRy and the image holder cleaner CLy are configured as an image holder unit that can be integrally attached to and detached from the image forming apparatus main body U2.

The visible image forming apparatuses Um, Uc and Uk are configured in the same manner as the Y visible image forming apparatus Uy.

In FIGS. 1 and 2, after being charged with each charger CRy, CRm, CRc and CRk, the photoreceptors PRy, PRm, PRc and PRk are formed with electrostatic latent images on surfaces thereof in image recording positions Q1*y*, Q1*m*, Q1*c* and Q1*k* by means of the latent image forming apparatuses LHy to LHk. The electrostatic latent images on the surfaces of the photoreceptors PRy, PRm, PRc and PRk are developed to toner images as an example of the visible images in developing regions Q2*y*, Q2*m*, Q2*c* and Q2*k* by means of the powder as an example of the particles maintained in developing rolls R0*y*, R0*m*, R0*c* and R0*k* as an example of the powder holders of the developing apparatuses Gy, Gm, Gc and Gk.

The toner images thus developed are transported to first transfer regions Q3*y*, Q3*m*, Q3*c* and Q3*k* which come in contact with an intermediate transfer belt B as one example of an intermediate transfer body A first transfer pressure, which has a polarity opposite to a charge polarity of the toner, is applied from a power source circuit E, which is controlled by a controlling portion C, to first transfer rollers T1*y*, T1*m*, T1*c* and T1*k*, which are disposed on the rear surface side of the intermediate belt B in the first transfer regions Q3*y*, Q3*m*, Q3*c* and Q3*k*, at a predetermined time.

The toner images on each of the photoreceptors PRy to PRk are first carried to the intermediate transfer belt B by the first transfer rollers T1*y*, T1*m*, T1*c* and T1*k*. The residues and the adherence matters on the surfaces of the photoreceptors PRy, PRm, PRc and PRk after the first transfer are cleaned by the image holder cleaners CLy, CLm, CLc and CLk. The front surfaces of the cleaned photoreceptors PRy, PRm, PRc and PRk are charged again by the chargers CRy, CRm, CRc and CRk.

A belt module BM as an example of the intermediate transfer apparatus that can be withdrawn forward is disposed at the upper parts of the photoreceptors PRy to PRk. The belt module BM has the intermediate transfer belt B, a belt drive roll Rd as an example of the intermediate transfer body drive member, a tension roll Rt as an example of intermediate transfer body installation member, a working roll Rw as an example of a meandering prevention member, an idle roll Rf as an example of a driven member, a back up roll T2*a* as an example of second transfer region opposing member, and the first transfer roller T1*y*, T1*m*, T1*c*, and T1*k*. Furthermore, the intermediate transfer belt B is supported in a rotationally movable manner by means of belt support rolls Rd, Rt, Rw, Rf and T2*a* as an example of an intermediate body support member that is constituted by each of the rolls Rd, Rt, Rw, Rf and T2*a*.

A second transfer roller T2*b* is disposed as an example of a second transfer member opposite to the surface of the intermediate belt B contacting the backup roll T2*a*, and the second transfer equipment T2 is constituted by each of the rolls T2*a* and T2*b*. In addition, in an opposing region of the second transfer roller T2*b* and the intermediate belt B, second transfer regions Q4 are formed.

The unicolor or multicolor toner image, which has been successively transferred onto the intermediate belt B in an overlapped manner by the first transfer rollers T1*y*, T1*m*, T1*c*, and T1*k* in the first transfer regions Q3*y*, Q3*m*, Q3*c* and Q3*k*, is transported to the second transfer regions Q4.

The transfer devices T1+T2+B of the first embodiment, which transfer the images formed on the photoreceptors PRy to PRk onto the medium, are constituted by the first transfer rollers T1*y* to T1*k*, the intermediate belt B and second transfer equipment T2 or the like.

In the lower part of the visible image forming apparatuses Uy to Uk, a pair of left and right guide rails GR as an example of a guide member is provided in three stages. In the guide rails GR, paper supplying trays TR1 to TR3 as an example of a paper supplying container are supported in such a manner that they can enter and exit in the front and rear direction. Recording sheets S as an example of the medium accommodated in the paper supplying trays TR1 to TR3 are removed by a pickup roll Rp as an example of a medium removing member and are singly separated by a handling roll Rs as an example of a medium handling member. Furthermore, the recording sheet S is transported by plural of carrying rollers Ra as an example of a medium carrying member along a sheet carrying path SH which is an example of the medium carrying path and are transported to a register roll Rr as an example of a transfer region carrying time regulating member which is disposed at the upstream side in the sheet carrying direction of the second transfer region Q4. The sheet carrying path SH, the sheet carrying roller Ra, and the register roll Rr or the like constitute the sheet carrying apparatuses SH+Ra+Rr.

The register roll Rr transports the recording sheet S to the second transfer region Q4 to match with the time when the toner image formed on the intermediate belt B is transported to the second transfer region Q4. When the recording sheets S pass through the second transfer region Q4, the backup roll T2*a* is grounded, and a second transfer voltage having a polarity opposite to the charge polarity of the toner is applied from the power supply circuit E controlled by the control portion C to the second transfer equipment T2*b*. At this time, the toner image on the intermediate belt B is transferred to the recording sheets S by the second transfer equipment T2.

The intermediate belt B after second transfer is cleaned by a belt cleaner CLb as an example of an intermediate body cleaner.

The recording sheets S, onto which the toner image is secondarily transferred, are transported to a fixing region Q5, which is a pressure fusing region of a heating roller Fh as an example of a heating fixing member of a fixing apparatus F and a pressing roller Fp as an example of a pressing fixing member and is fixed by heating when passing through the fixing region. The recording sheets S which have been fixed by heating are discharged from a discharge roller Rh as an example of a medium discharge member to a paper discharge tray TRh as an example of a medium discharge portion.

Furthermore, on the front surface of the heating roller Fh, a releasing agent for making a separation property of the recording sheet S from the heating roller satisfactory is applied by means of a releasing agent applying apparatus Fa.

In FIG. 1, the image forming apparatus U has an upper frame UF and a lower frame LF, and in the upper frame UF, the visible image forming apparatuses Uy to Uk and a member, which is disposed at the upper part of the visible image forming apparatuses Uy to Uk, i.e., the belt module BM or the like, are supported.

Furthermore, in the lower frame LF, the guide rail GR for supporting the paper supplying trays TR1 to TR3 and the paper supplying member for supplying the paper from each of the trays TR1 to TR3, i.e., the pickup roll Rp, the handling roll Rs and the sheet carrying roller Ra or the like are supported.

Figure 3:
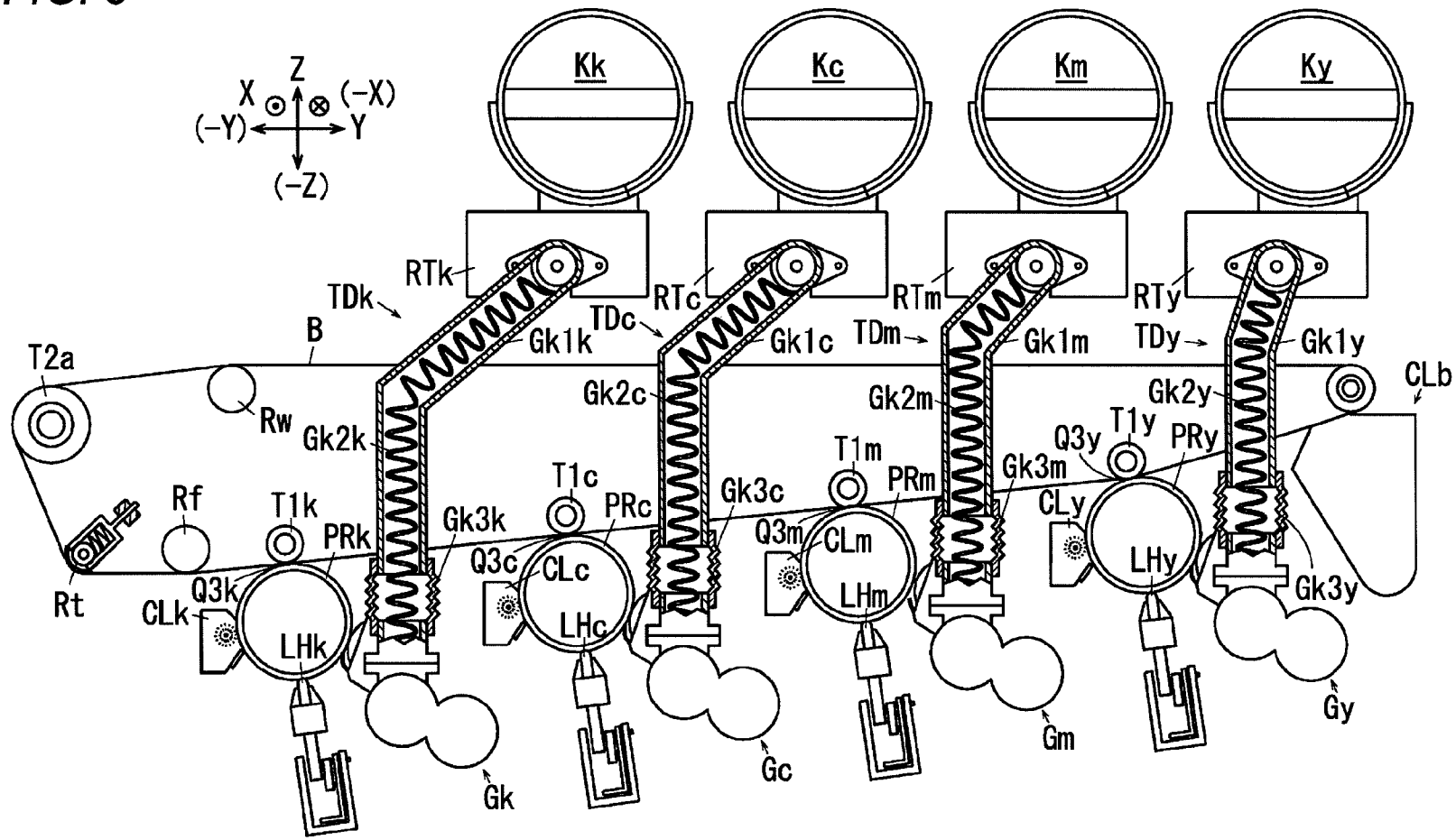
FIG. 3 is a diagram of a powder supply apparatus of the first embodiment.

FIG. 3 is a diagram of the powder supply apparatus of the first embodiment.

Furthermore, in FIG. 3, for the purpose of facilitating understanding, for example, the showing of the members such as the chargers CRy to CRk is suitably omitted.

In FIGS. 1 and 3, on the upper part of the belt module BM, toner cartridges Ky, Km, Kc and Kk as an example of a powder accommodation container which accommodate each of the powder of yellow Y, magenta M, cyan C and black K are disposed. The toner cartridges Ky to Kk are detachably supported in the toner dispensers TDy, TDm, TDc and TDk that supply the powder accommodated in the toner cartridges Ky to Kk to the developing apparatuses Gy to Gk, as an example of a powder carrying apparatus which is an example of a power supply apparatus.

Each of the toner dispensers TDy to TDk have reserve tanks RTy to RTk as an example of storage portions in which the powder from the toner cartridges Ky to Kk are temporarily stored, and powder supply paths GK1*y* to GK1*k* that extend from the reserve tanks RTy to RTk to the developing apparatuses Gy to Gk and in which the powder is transported.

In the inner part of the powder supply paths GK1*y* to GK1*k*, augers GK2*y* to GK2*k* as an example of the powder supply member which rotate to carry the powder within the powder supply paths GK1*y* to GK1*k* are disposed. In the end portions of the powder supply paths GK1*y* to GK1*k* facing the developing apparatuses Gy to Gk, bellows-shaped connection members GK3*y* to GK3*k* are disposed for maintaining the connection state of the powder supply paths GK1*y* to GK1*k* when the developing apparatuses Gy to Gk are moved for maintenance, inspection, exchange or the like. The powder accommodated in each of the toner cartridges Ky to Kk are supplied to each of the developing apparatuses Gy to Gk depending on the consumption of the powder of the developing apparatuses Gy to Gk. Furthermore, in the first embodiment, the powder used in the developing apparatuses Gy to Gk are constituted by bicomponent powder including the magnetic carrier and toner, and so-called high concentration toner of which a ratio of the toner relative to the carrier is higher than the powder in the developing apparatuses Gy to Gk is supplied from the toner cartridges Ky to Kk.

Figure 4:
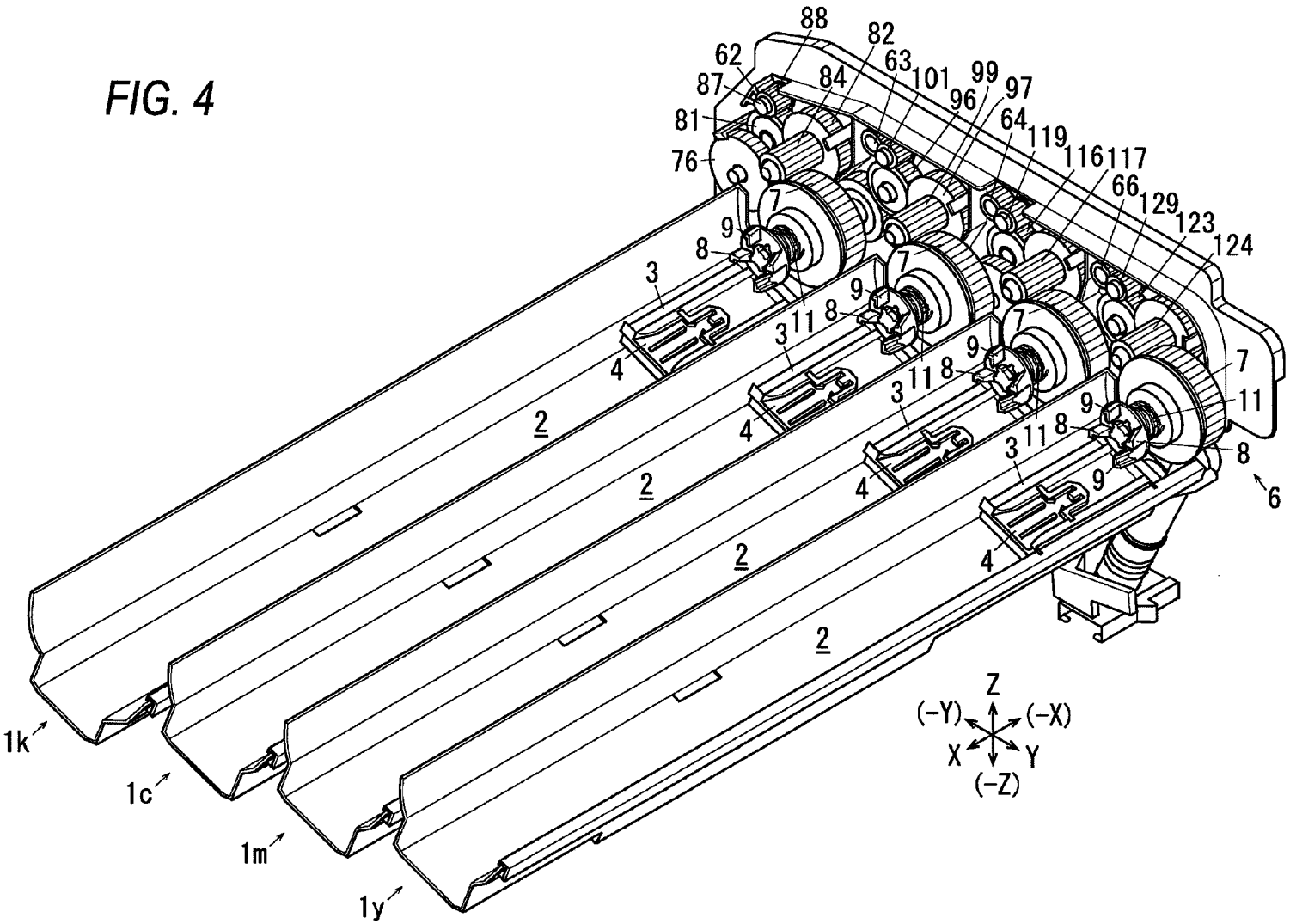
FIG. 4 is a perspective diagram of principal parts of the powder carrying apparatus in a state in which a powder accommodating container is removed from an accommodating container grasping portion of the first embodiment.

(Description of the Powder Supplying Apparatus) FIG. 4 is a perspective diagram of the principal parts of a powder carrying apparatus with the powder accommodating container removed from the accommodating container grasping portion of the first embodiment.

In FIG. 4, each of the toner dispensers TDy to TDk of the first embodiment has cartridge holders 1*y* to 1*k* which are detachably supported corresponding to the toner cartridges Ky to Kk, as an example of accommodation container retaining apparatuses.

Next, while the detailed description of cartridge holders 1*y* to 1*k* of the first embodiment will be given, because each of the cartridge holders 1*y* to 1*k* has an identical structure, the description will be given for a Y color cartridge holder 1*y*, and with regard to the other color cartridge holders 1*m* to 1*k*, the detailed description thereof will be omitted.

The cartridge holder 1*y* has a holder main body 2, which is disposed at the lower part of the cartridge holder 1*y* and extends in the front and rear direction, as an example of the accommodating container retaining bottom wall. In FIG. 4, at the rear end portion of the holder main body 2, an inflow opening portion 3 with an inflow opening (not shown) formed therein is formed. In the inflow opening portion 3, an inflow opening shutter 4 is disposed which is movably supported in the front and rear direction and opens and closes the inflow opening portion 3 as an example of an inflow opening open and close portion.

Furthermore, since this kind of inflow opening shutter 4 is well known in the related art and, for example, is described in JP-A 2007-328194 and JP-A 2008-298879 or the like, the detailed description thereof will be omitted.

In the rear part of the holder main body 2, a driven portion 6 is rotatably supported via a rear wall (not shown). The driven portion 6 has a carrying gear portion 7 as an example of a carrying gear. In the front end of the carrying gear portion 7, as an example of a drive carrying member supporting shaft, a coupling support shaft 8 extending in the front direction is supported. In the coupling support shaft 8, a drive coupling 9 as an example of the drive carrying member is supported movably in the front and rear direction. In the coupling support shaft 8, as an example of a pressing member, a coupling spring 11 is mounted which presses the drive coupling 9 in the front direction.

(Description of the Cartridge)

Figure 5:
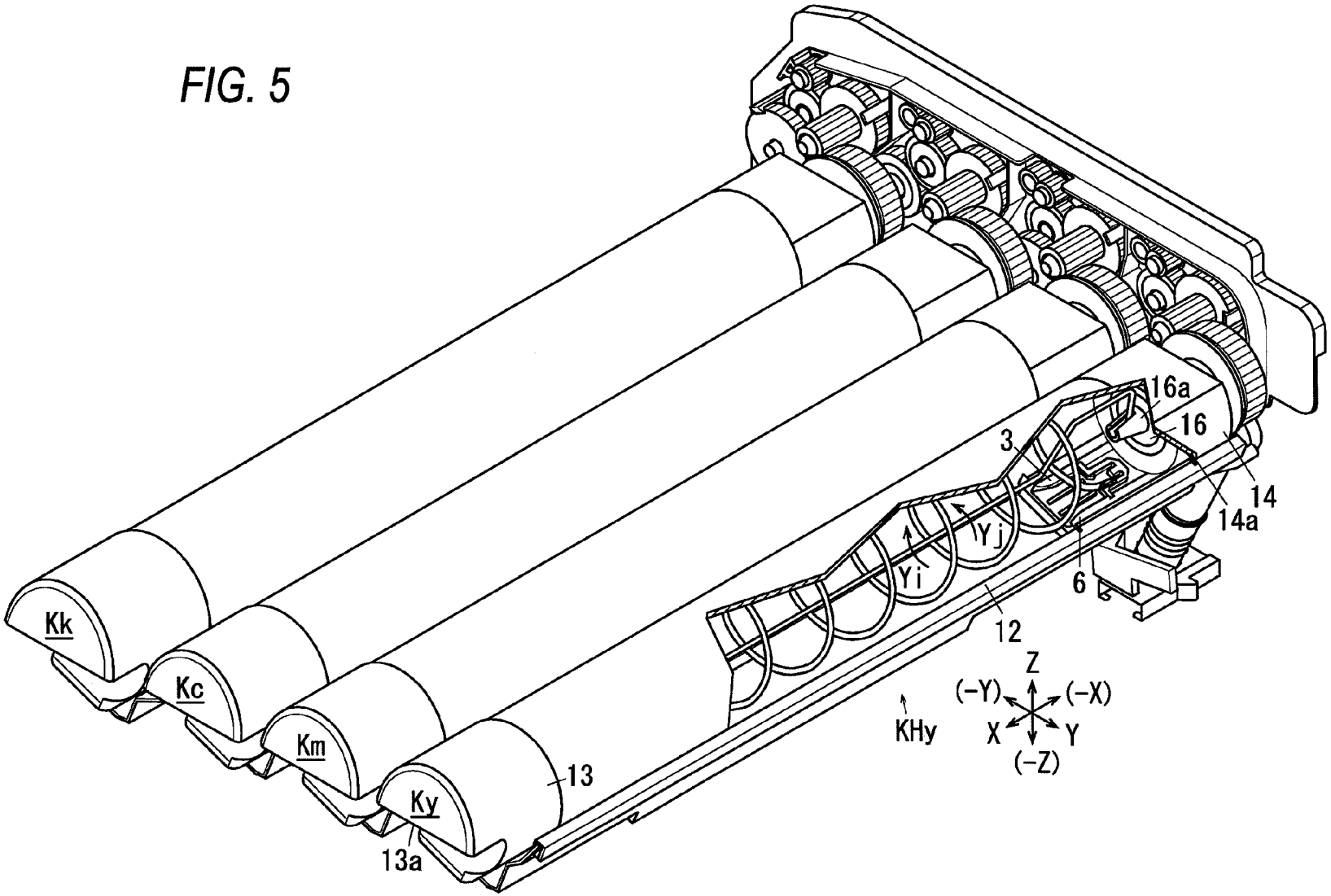
FIG. 5 is a perspective diagram of principal parts of the powder carrying apparatus in a state in which the accommodating container grasping portion of the first embodiment is equipped with the powder accommodating container.

FIG. 5 is a perspective diagram of the principal parts of the powder carrying apparatus in a state in which the powder accommodating container is mounted on the accommodating container grasping portion of the first embodiment.

Figure 6:
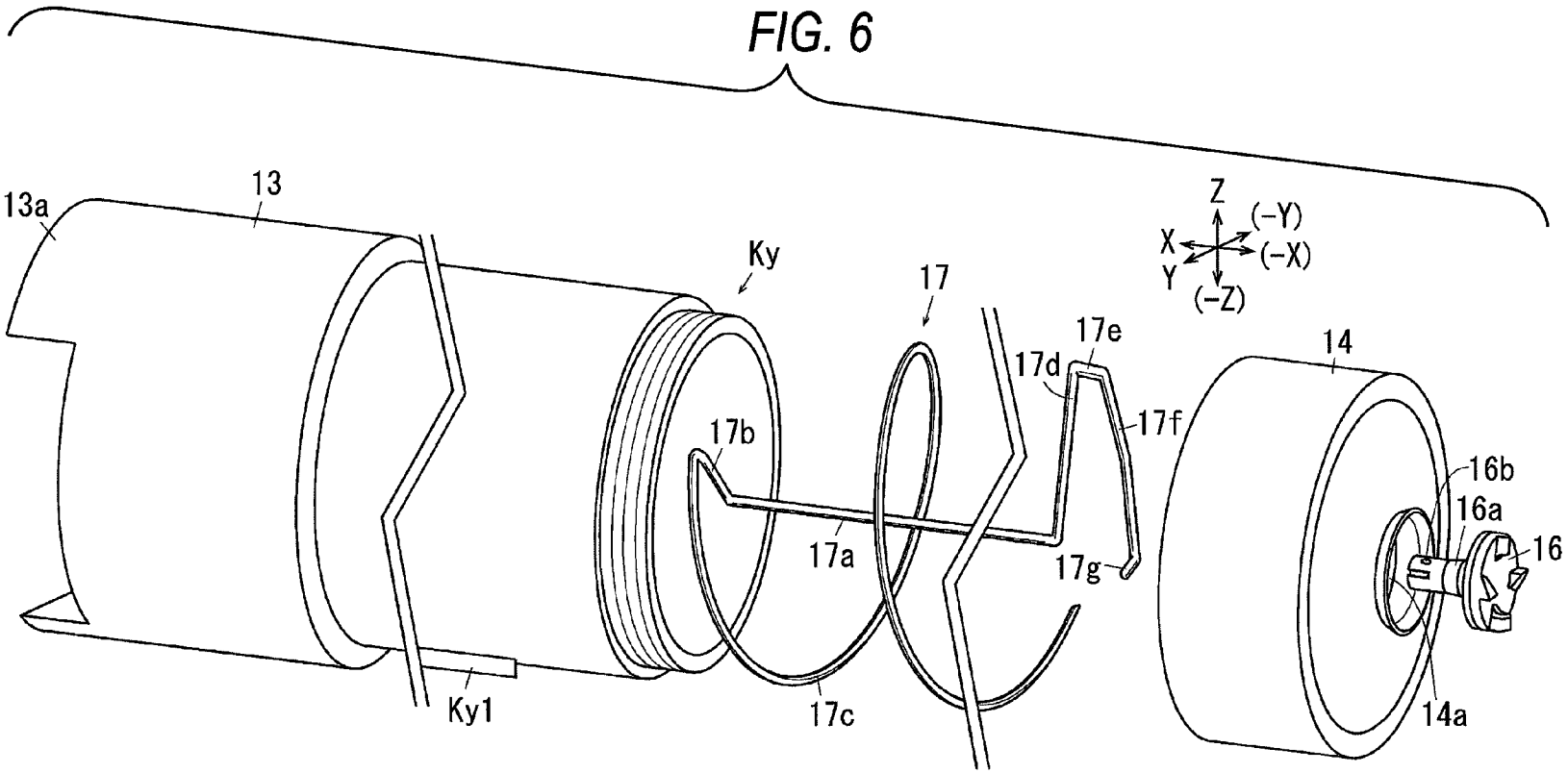
FIG. 6 is a disassembled diagram of the powder accommodating container of the first embodiment.

FIG. 6 is a disassembled diagram of the powder accommodating container of the first embodiment.

In FIGS. 5 and 6, the toner cartridge Ky has a cartridge main body 12 as an example of the container main body which is an example of a powder accommodating portion. The cartridge main body 12 is formed in a substantially cylindrical shape extending in the front and rear direction, and the powder is accommodated therein. In the front end portion of the cartridge main body 12, a front cover 13 as an example of a container front end member is supported. On the front cover 13, a grasping portion 13*a* for grasping by a user when the toner cartridge Ky is exchanged is formed.

On the outer peripheral surface of the cartridge main body 12, a supply opening (not shown) as an example of an outlet portion through which the powder in the cartridge main body 12 flows out is formed. On the supply opening, a cartridge shutter Ky1 as an example of an accommodating portion opening and closing member is mounted which moves to be opened and closed when the toner cartridge Ky is detachably attached to the image forming apparatus main body U1. Furthermore, a structure in which the cartridge shutter Ky1 is opened and closed due to the removing of the cartridge Ky is disclosed in the related art, and the structure is, for example, described in JP-A 2007-328194 and JP-A 2008-298879, and thus the detailed description thereof will be omitted.

Furthermore, in the rear end portion of the cartridge main body 12, a rear cover 14 as an example of a container rear end member is supported. In the rear end of the rear cover 14, a support hole 14*a* as an example of a carrying member support portion is formed.

In the support hole 14*a*, a shaft portion 16*a* of a driven coupling 16 as an example of the driven carrying member is rotatably supported in a state of passing therethrough. The driven coupling 16 is engaged with the driving coupling 9 and the drive force is carried when the image forming apparatus U is mounted. Furthermore, since the driving coupling and the driven coupling are described, for example, in JP-A 2004-252184, JP-A 2005-134452 and JP-A 2005-181515 and are well known in the related art, the showing and the detailed description thereof will be omitted.

On the front end portion of the shaft portion 16*a*, a hole-shaped carrying member support hole 16*b* is formed.

In addition, in the inner part of the cartridge Ky, an agitator 17 as an example of a powder carrying member is disposed. The agitator 17 of the first embodiment has a main body rod-shaped portion 17*a* extending in the axial direction, a connecting portion 17*b* obliquely extending in a radial direction of the rotation shaft, a spiral carrying portion 17*c* extending from the outer end of the connecting portion 17*b* toward the rear direction, a second radial direction bent portion 17*d* extending from the rear end of the main rod-shaped portion 17*a* in a second radial direction, an axial direction elongation portion 17*e* extending from the outer end portion of the radial direction of the second radial direction bent portion 17*d* in the axial direction, a second radial direction elongation portion 17*f* extending from the left end of the axial direction elongation portion 17*e* to the rotation center side along the second radial direction, and a first radial direction elongation portion 17*g* extending from the rotation center side of the second radial direction elongation portion 17*f* in the first radial direction.

The first radial direction elongation portion 17*g* is fitted into the carrying member support hole 16*b*, whereby the agitator 17 of the first embodiment is mounted on the driven coupling 16. Thus, when the driving force is carried to the driven coupling 16 via the driving coupling 9, the agitator 17 is rotated and the powder in the cartridge main body 12 is transported toward the supply opening.

(Description of Drive Unit)

Figure 7:
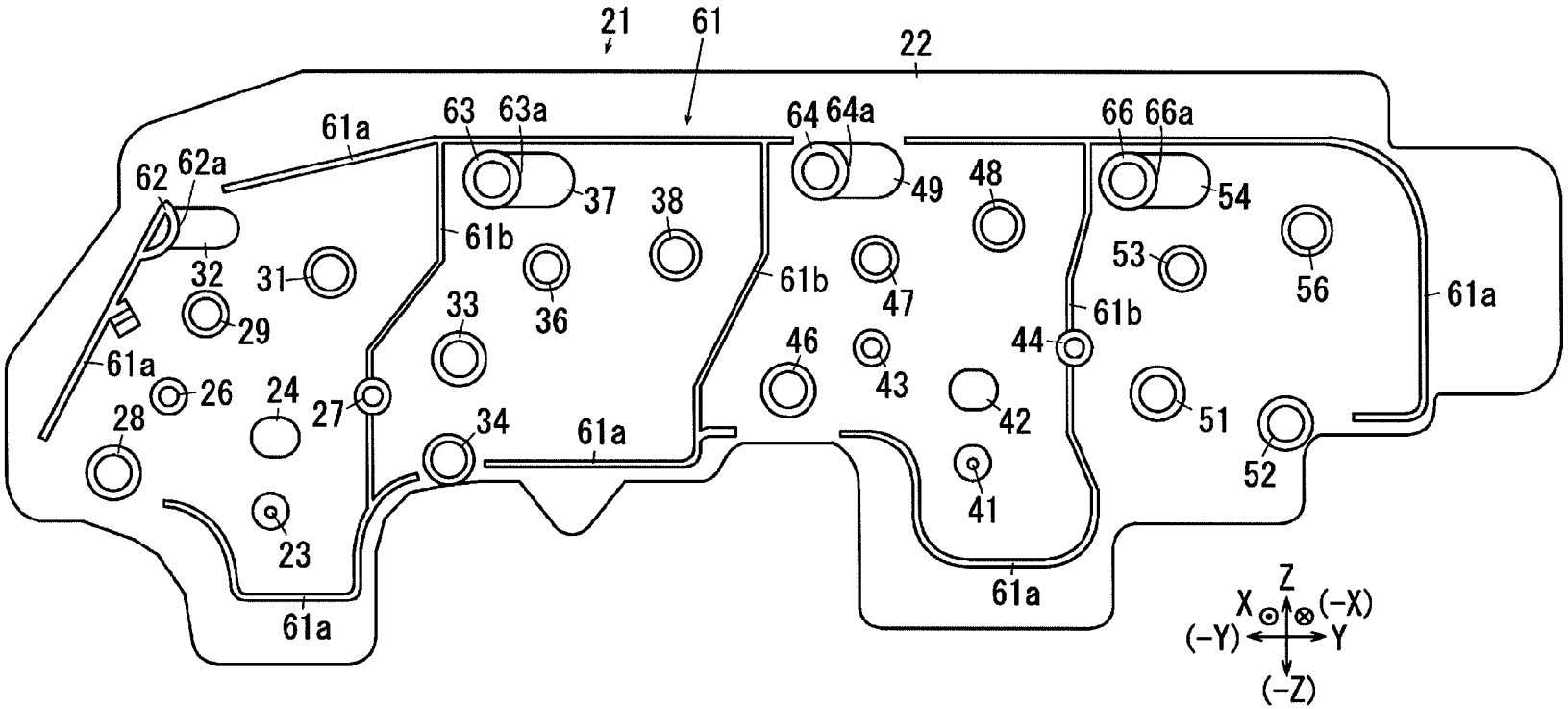
FIG. 7 is a diagram of a gear unit frame of the first embodiment.

FIG. 7 is a diagram of a gear unit frame of the first embodiment.

In FIGS. 4 and 5, in the rear parts of each of the cartridge holders 1*y* to 1*k*, as an example of a gear receiving unit, a gear unit 21 is disposed. The gear unit 21 has a gear unit plate 22 extending in the left and right direction, as an example of a gear unit frame. In FIG. 7, in the left lower end portion of the gear unit plate 22, a hole-shaped CK drive shaft hole 23 is formed as an example of a first drive shaft hole. In the upper part of the CK drive shaft hole 23, as an example of a first rolling guide portion, a long hole-shaped CK rolling guide hole 24 extending in the left and right direction is formed. In the left upper part of the CK rolling guide hole 24, as an example of a first middle gear shaft, a K middle gear shaft 26 extending in the front direction is supported. In the right upper part of the CK rolling guide hole 24, as an example of a second middle gear shaft, a C middle gear shaft 27 extending in the front direction is supported.

In the left lower part of the K middle gear shaft 26, as an example of a first supply gear shaft, a K supply gear shaft 28 extending in the front direction is supported. In the right upper part of the K middle gear shaft 26, as an example of a first regulated shaft, a K regulated shaft 29 extending in the front direction is supported. In the right upper part of the K regulated shaft 29, as an example of a first carrying engagement shaft, a K carrying engagement shaft 31 extending in the front direction is supported. In the upper part of the K regulated shaft 29, as an example of a first regulation guide hole, a long hole-shaped K swing guide hole 32 extending in the left and right direction is formed.

In addition, in the right upper part of the C middle gear shaft 27, as an example of a first relay shaft, a C relay shaft 33 extending in the front direction is supported. In the lower part of the C relay shaft 33, a C supply gear shaft 34 as an example of a second supply gear shaft is supported. In the right upper part of the C relay shaft 33, as an example of a second regulated shaft, a C regulated shaft 36 extending in the front direction is supported. In the upper part of the C regulated shaft 36, as an example of a second regulation guide hole, a long hole-shaped C swing guide hole 37 extending in the left and right direction is formed. In the right part of the C regulated shaft 36, as an example of a second carrying engagement shaft, a C carrying engagement shaft 38 extending in the front direction is supported.

In the right lower end portion of the gear unit plate 22, as an example of a second drive shaft hole, a hole-shaped YM drive shaft hole 41 is formed. In the upper part of the YM drive shaft hole 41, as an example of a second rolling guide portion, a long-hole shaped YM rolling guide hole 42 extending in the left and right direction is formed. In the left upper part of the YM rolling guide hole 42, as an example of a first middle gear, a M middle gear shaft 43 extending in the front direction is supported, and in the right upper part of the YM rolling guide hole 42, as an example of a second middle gear, a Y middle gear shaft 44 extending in the front direction is supported.

In the left lower part of the M middle gear shaft 43, an M supply gear shaft 46 as an example of a first supply gear shaft is supported, and in the left upper part of the M middle gear shaft 43, as an example of a first regulated shaft, an M regulated shaft 47 extending in the front direction is supported. In the upper part of the M regulated shaft 47, as an example of a first carrying engagement shaft, an M carrying engagement shaft 48 extending in the front direction is supported, and in the upper part of the M regulated shaft 47, as an example of a first regulation guide hole, a long hole-shaped M swing guide hole 49 extending in the left and right direction is formed.

Furthermore, in the right lower part of the Y middle gear shaft 44, as an example of a second relay shaft, a Y relay shaft 51 extending in the front direction is supported. In the right lower part of the Y relay shaft 51, as an example of a second supply gear shaft, a Y supply gear shaft 52 is supported, and in the right upper part of the Y relay shaft 51, as an example of a second regulation shaft, a Y regulated shaft 53 extending in the front direction is supported. In the upper part of the Y regulated shaft 53, as an example of a second regulated guide hole, a long hole-shaped Y swing guide hole 54 extending in the left and right direction is formed, and in the right upper part of the Y regulated shaft 53, as an example of a second carrying engagement shaft, a Y carrying engagement shaft 56 extending in the front direction is supported.

On the front surface of the gear unit plate 22, as an example of a frame, a rib 61 extending from the front surface of the gear unit plate 22 in the front direction is disposed. The rib 61 has plural of outer end portions 61*a* formed along the outer edge of the gear unit plate 22 and plural of inner elongation portions 61*b* extending from the outer edge portion 61*a* to the inner side. The rib 61 is configured such that when a gear described later is erroneously mounted, it can interfere with the gear to completely mount the gear, while enhancing the rigidity of the gear unit plate 22. Additionally, on the left upper end portion of the gear unit plate 22, as an example of a first fixing portion, an arched K fixing portion 62 expanding from the outer edge portion 61*b* in the right direction is formed at a position corresponding to the left side of the K swing guide hole 32, and on the outer peripheral surface of the K fixing portion 62, K fixing teeth 62*a* as an example of first fixing teeth are formed.

In the gear unit plate 22, as a second securing portion, a cylindrical C securing portion 63 extending from the front surface of the gear unit plate 22 in the front direction is formed at a position corresponding to the left side of the C swing guide hole 37. On the right outer peripheral portion of the C securing portion 63, C fixing teeth 63*a* as second fixing teeth are formed.

Additionally, at a position corresponding to the left side of the M swing guide hole 49 and a position corresponding to the left side of the Y swing guide hole 54, a M fixing portion 64 as a first fixing portion and a Y fixing portion 66 as a second fixing portion are formed in a cylindrical shape extending from the front surface of the gear unit plate 22 in the front direction. On the right outer peripheral surfaces of the M fixing portion 64 and the Y fixing portion 66, M fixing teeth 64*a* as first fixing teeth and Y fixing teeth 66*a* as second fixing teeth are formed.

Figure 8:
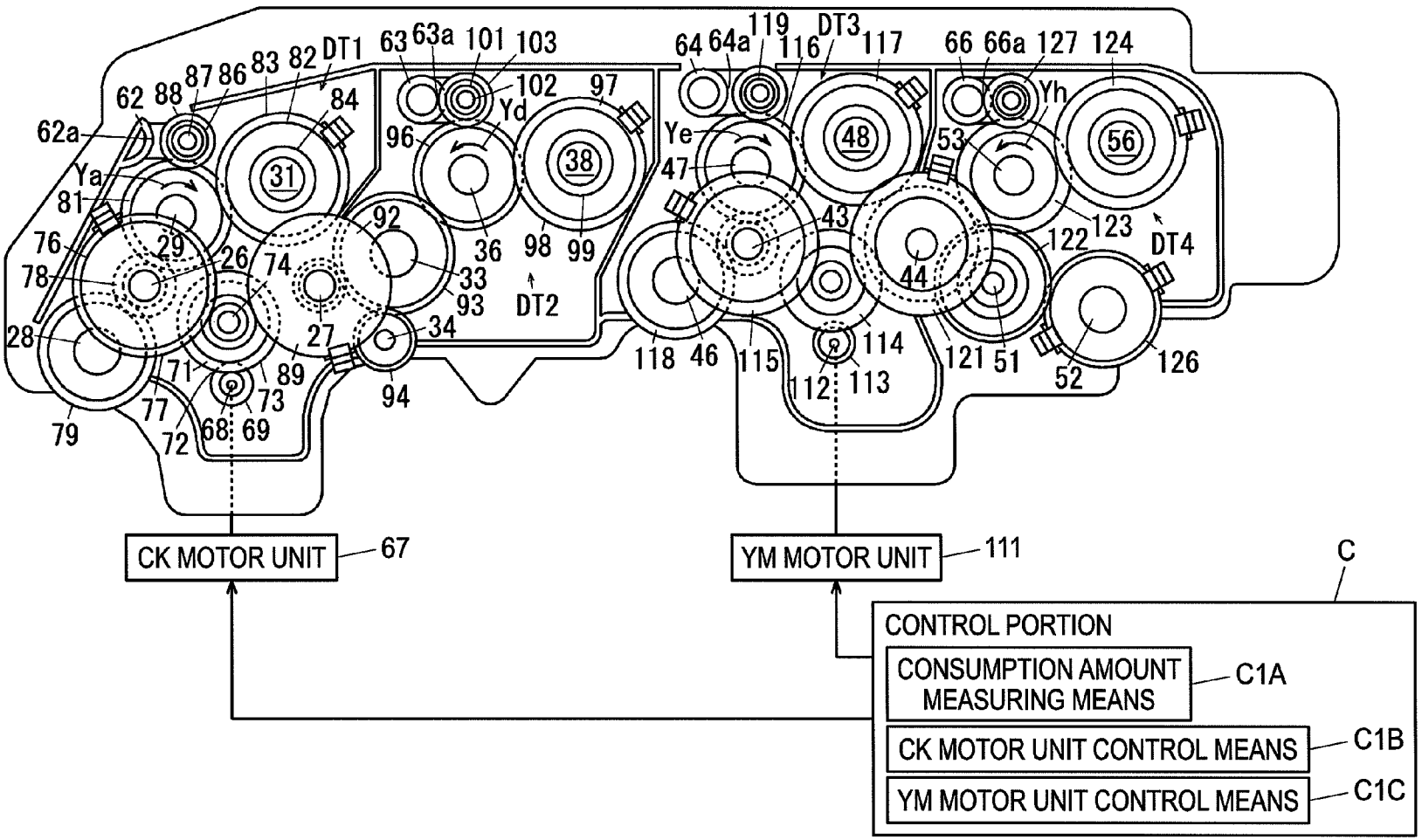
FIG. 8 is a diagram of principal parts when a first drive source of a gear receiving unit of the first embodiment rotates positive.

FIG. 8 is a diagram of the principal parts in a case where the first drive source of the gear receiving unit of the first embodiment rotates positive.

Figure 9:
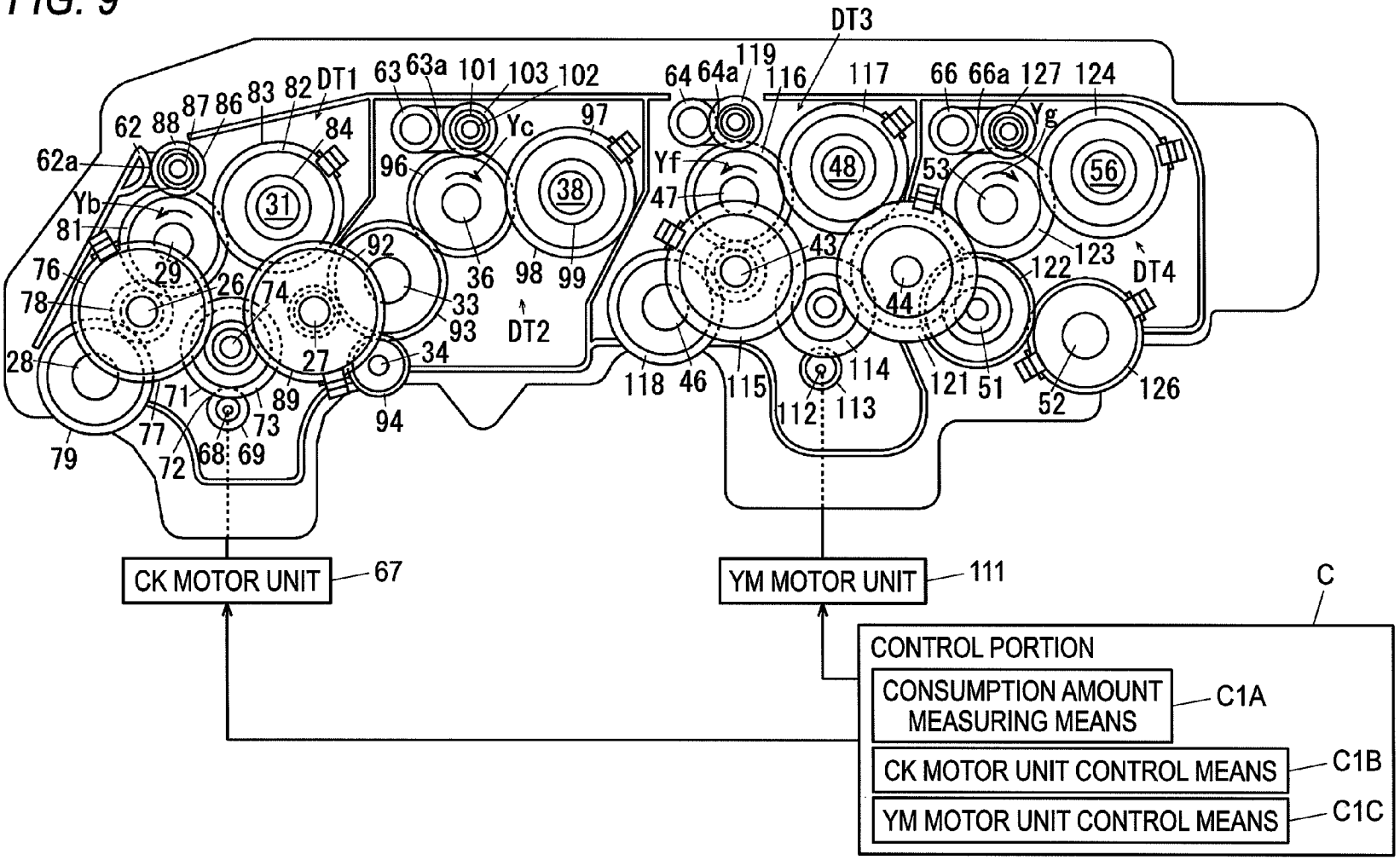
FIG. 9 is a diagram of principal parts when a first drive source of a gear receiving unit of the first embodiment rotates negative.

FIG. 9 is a diagram of the principal part in a case where the first drive source of the gear receiving unit of the first embodiment rotates negative.

Figure 10A:
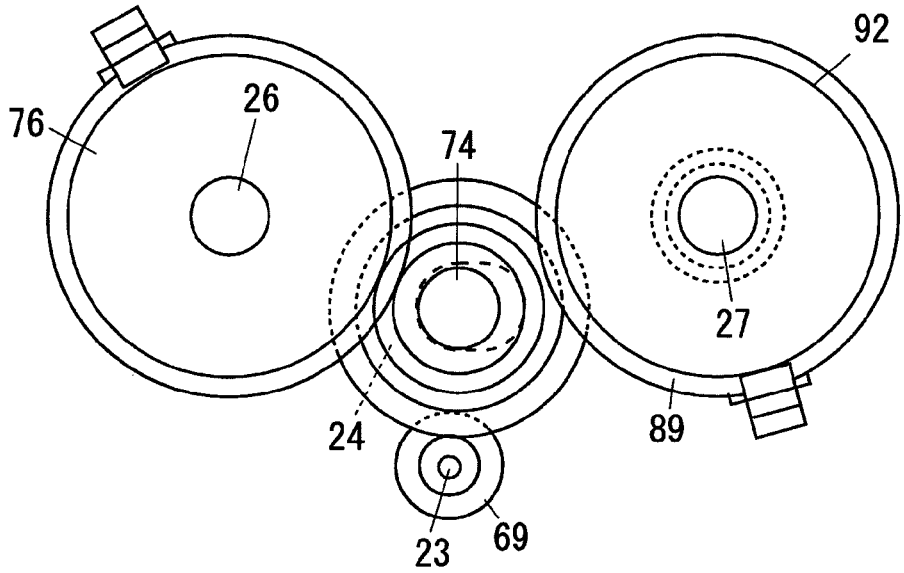
Figure 10B:
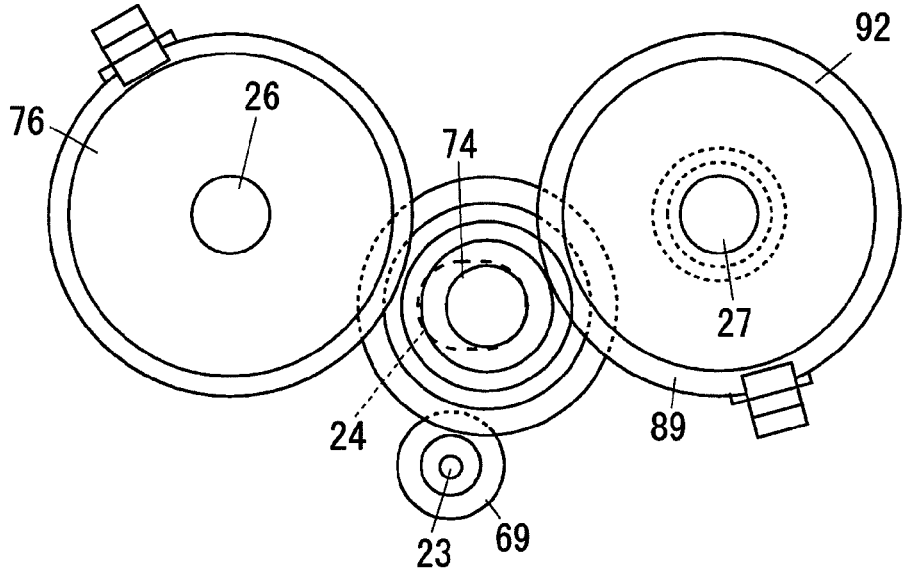

FIG. 10 is an enlarged view of the principal parts of the rolling gear of the first embodiment, FIG. 10A is a diagram of a state in which a first rolling gear is moved to a first rocking position, and FIG. 10B is a diagram of a state in which a first rolling gear is moved to a second rocking position.

In FIGS. 7 to 9, in the rear surface of the gear unit plate 22, at a position corresponding to the CK drive shaft hole 23, as an example of a first drive source, a CK motor unit 67 capable of rotating positive and negative is supported.

The CK motor unit 67 has a rotatable CK drive shaft 68, as an example of a first drive shaft, which passes through the Ck drive shaft 23 and extends in the front direction. In the front end portion of the CK drive shaft 68, a CK driving gear 69 as an example of a first drive gear is supported.

In FIGS. 8 to 10, in the upper part of the Ck driving gear 69, as an example of a first rolling gear, a CK rolling gear 71 is disposed. The CK rolling gear 71 has a CK rolling shaft 72 which is rotatably supported by the CK rolling guide hole 24, as an example of a first rolling shaft, a CK drive engagement portion 73 as an example of a first drive engagement portion engaged with the CK driving gear 69, and a rolling engagement portion 74 as an example of the first rolling engagement portion which is coaxial with the CK drive engagement portion 73 and is disposed in the front side.

The CK rolling shaft 72 of the first embodiment has a diameter smaller than that of the CK rolling guide hole 24 in the up and down direction and is supported movably in the left and right direction and the up and down direction along the CK rolling guide hole 24. Thus, the CK rolling gear 71 is supported movably between a K carrying position shown in FIG. 10A where the CK rolling shaft 72 is moved to the left side of the CK rolling guide hole 24, as an example of a first rocking position, and a C carrying position shown in FIG. 10B where the CK rolling shaft 72 is moved to the right side of the CK rolling guide hole 24, as an example of a second rocking position. Therefore, in a state in which the CK drive engagement portion 73 is engaged with the CK driving gear 69, when the CK driving gear 69 rotates positive, as shown in FIG. 8, the CK rolling gear 71 is moved to the K carrying position along the outer periphery of the CK driving gear 69, and when the CK driving gear 69 rotates negative, as shown in FIG. 9, the CK rolling gear 71 is moved to the C carrying position along the outer periphery of the CK driving gear 69.

In the K middle gear shaft 26, a K middle gear 76 as an example of a first middle gear is rotatably supported. The K middle gear 76 has a K middle engagement portion 77 which is engaged with the rolling engagement portion 74 moved to the K carrying position, as an example of a first middle engagement portion, and a K middle carrying engagement portion 78 which is coaxial with the K middle engagement portion 77 and disposed in the rear side, as a first middle carrying engagement portion.

In the K supply gear shaft 28, a K supply gear 79 as an example of a first supply gear is rotatably supported. The K supply gear 79 is engaged with the K middle carrying engagement portion 78. Furthermore, the K supply gear 79 is engaged with a K auger driving gear (not shown) as an example of a first supply drive gear, and drives the auger GK2*k* via the K auger driving gear.

In the K regulated shaft 29, a K regulated gear 81 as an example of a first regulated gear is rotatably supported. The K regulated gear 81 is engaged with the K middle carrying engagement portion 78.

In the K carrying engagement shaft 31, a K carrying engagement gear 82 as an example of a first carrying engagement gear is rotatably supported. The K carrying engagement gear 82 has a K regulated engagement portion 83 which is engaged with the K regulated gear 81, as an example of a first regulated engagement portion, and a K carrying engagement portion 84 as an example of a first carrying engagement portion which is coaxial with the K regulated engagement portion 83 and is disposed in the front side. In FIG. 4, the K carrying engagement portion 84 is engaged with the regulated gear portion 7 and is capable of carrying the drive to the agitator 17 via the regulated gear portion 7 and the drive coupling 9 or the like.

Figure 11A:
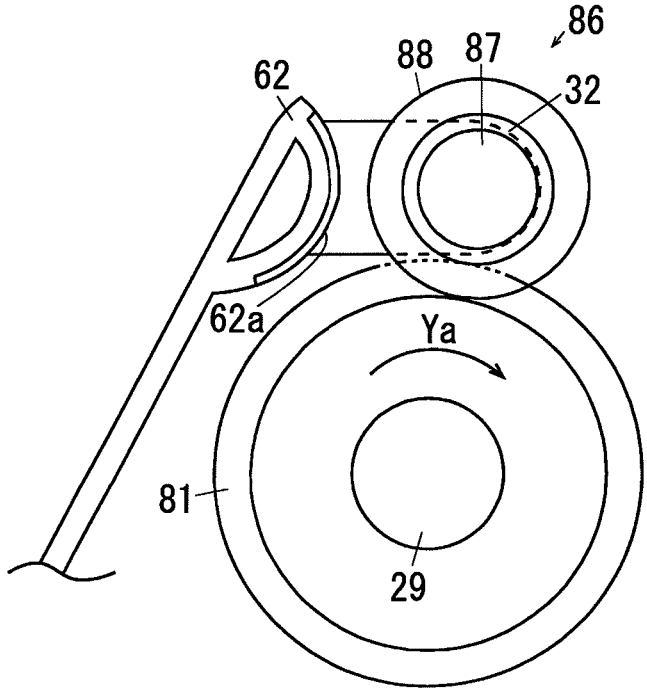
Figure 11B:
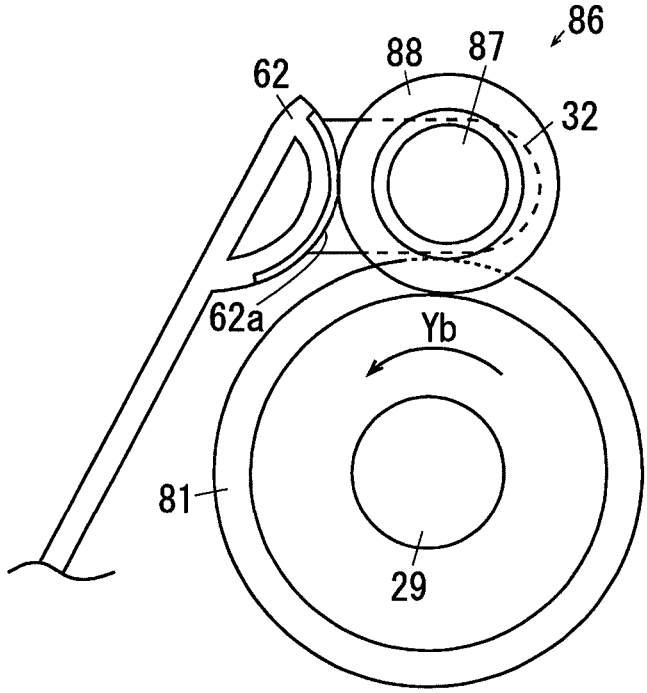

FIG. 11 is an enlarged view of the principal parts of a first regulating gear of the first embodiment, FIG. 11A is a diagram of a state in which a first regulating gear is moved to a first release position, and FIG. 11B is a diagram of a state in which a first regulating gear is moved to a first regulation position.

In FIGS. 8, 9 and 11, at the upper part of the K regulated gear 81, as an example of a first regulating gear, a K swing gear 86 is disposed. The K swing gear 86 has a K swing shaft 87 which is rotatably supported by the K swing guide hole 32, as an example of a first regulating shaft, and a K swing engagement position 88 as an example of a first regulating engagement portion engaged with the K regulated gear 81.

The diameter of the K swing shaft 87 of the first embodiment is smaller than the diameter of the K swing guide hole 32 in the left and right direction, and is rotatably supported in the up and down direction and the up and down direction along the K swing guide hole 32. Thus, the K swing gear 86 is rotatably supported between a K release position shown in FIG. 11A where the K swing shaft 87 moves to the right side of the K swing guide hole 32 and is separated from the K fixing portion 62, as an example of a first release position, and a K regulation position shown in FIG. 11B where the K swing shaft 87 moves to the left side of the K swing guide hole 32 and is engaged with the K fixing teeth 62*a* of the K fixing portion 62, as an example of a first regulation position.

Thus, in a state in which the K swing engagement portion 88 is engaged with the K regulated gear 81, when the CK driving gear 69 rotates positive, as shown in FIG. 8, via the CK rolling gear 71 or the like that has been moved to the K rocking position, the reverse rotation drive is carried to the K regulated gear 81, so that the K regulated gear 81 is rotated in the arrow Ya direction, with the result that the K swing gear 84 is moved to the K release position along the outer periphery of the K regulated gear 81. Furthermore, after the positive rotation of the CK driving gear 69 is stopped, as shown in FIG. 9, when a force that causes the K regulated gear 81 to rotate in the arrow Yb direction acts, the K swing gear 86 is moved to the K regulation position along the outer periphery of the K regulated gear 81, so that the K swing engagement portion 88 is engaged with the K fixing teeth 62*a*, whereby the rotation of the K regulated gear 81 is regulated.

A K middle transmission system DT1 as an example of a first middle transmission system is constituted by the K middle gear 76, the K regulated gear 81 and the K carrying engagement gear 82.

In FIGS. 8 and 9, in the C middle gear 27 shaft, a C middle gear 89 as an example of a second middle gear is rotatably supported. The C middle gear 89 has a C middle engagement portion 91 which is engaged with the rolling engagement portion 74 in a state of being moved to the C carrying position, as an example of a second middle engagement portion, and a C middle carrying engagement portion 92 which is coaxial with the C middle engagement portion 91 and is disposed at the rear side, as a second middle carrying engagement portion.

In the C relay shaft 33, a C relay gear 93 as an example of a second relay gear is rotatably supported. The C relay gear 93 is engaged with the C middle carrying engagement portion 92.

In FIGS. 7 to 9, in the C supply gear shaft 34, a C supply gear 94 as an example of a second supply gear is rotatably supported. The C supply gear 94 is engaged with the C relay gear 93. Furthermore, the C supply gear 94 is engaged with a C auger driving gear (not shown) as an example of a second supply drive gear and drives the auger GK2*c* via the C auger driving gear.

In the C regulated shaft 36, a C regulated gear 96 as an example of a second regulated gear is rotatably supported. The C regulated gear 96 is engaged with the C relay gear 93.

In the C carrying engagement shaft 38, a C carrying engagement gear 97 as an example of a second carrying gear is rotatably supported. The C carrying engagement gear 97 has a C regulated engagement portion 98 engaged with the C regulated gear 96, as an example of a second regulated engagement portion, and a C carrying engagement portion 99 as an example of a second carrying engagement portion which is coaxial with the C regulated engagement portion 98 and is disposed at the front side. In FIG. 4, the C carrying engagement portion 99 is engaged with the regulated gear portion 7 of the cartridge holder 1*c*, and is capable of carrying the drive to the agitator 17 of the toner cartridge Kc via the driven gear portion 7 and the drive coupling 9 or the like.

At the upper part of the C regulated gear 96, as an example of a second regulating gear, a C swing gear 101 is disposed. The C swing gear 101 has a C swing shaft 102 which is rotatably supported by the C swing guide hole 37, as an example of a second regulating shaft, and a C swing engagement portion 103 as an example of a second regulating engagement portion which is engaged with the C regulated gear 96.

Similarly to the K swing gear 84, the diameter of the C swing shaft 102 of the first embodiment is smaller than the diameter of the C swing guide hole 37 in the up and down direction, and is movably supported in the left and right direction and the up and down direction along the C swing guide hole 37. Thus, the C swing gear 101 is movably supported between a C release position as shown in FIG. 9 where the C swing shaft 102 is moved to the right side of the C swing guide hole 37 and is separated from a C fixing portion 63 described below, as an example of a first release position, and a C regulation position as shown in FIG. 8 where a C swing shaft 102 is moved to the left side of the C swing guide hole 37 and is engaged with the C fixing portion 63, as an example of a second regulation position.

Thus, when the CK driving gear 69 rotates negative, as shown in FIG. 9, the negative rotation drive is carried to the C regulated gear 96 via the Ck rolling gear 71 which has been moved to the second rocking position or the like, so that the C regulated gear 96 rotates in the arrow Yc direction, and the C swing gear 101 is moved to the C release position and is separated from the C fixing portion.

Furthermore, after the negative rotation of the CK driving gear 69 is stopped, as shown in FIG. 8, when a force that causes the C regulated gear 96 to rotate in the arrow Yd direction acts, the C swing gear 101 is moved to the C regulation position and is engaged with the C fixing teeth 63*a*, whereby the rotation of the C regulated gear 96 is regulated.

A C middle transmission system DT2 as an example of a second middle transmission system is constituted by the C middle gear 89, the C relay gear 93, the C regulated gear 96 and the C carrying engagement gear 97 or the like.

In addition, a CK drive system 104 as an example of a drive apparatus for driving the toner dispensers TDc and TDk is constituted by the CK motor unit 67, the CK rolling gear 71, the K middle transmission system DT1 and the C middle transmission system DT2 or the like.

In FIGS. 8 and 9, in the rear surface of the gear unit plate 22, at a position corresponding to the YM drive shaft hole 41, similarly to the CK motor unit 67, a YM motor unit 111 that can be rotated positive and negative is supported. The YM motor unit 111 has a YM drive shaft 112 corresponding to the CK drive shaft 68 and a YM driving gear 113 corresponding to the CK driving gear 69 is supported by the front end portion of the YM drive shaft 112.

At the upper part of the YM driving gear 113, a YM rolling gear 114 that has the same structure as the CK rolling gear 71 is disposed and is movably supported between an M carrying position shown in FIG. 8 and a Y carrying position shown in FIG. 9 along with the rotation of the YM driving gear 113.

An M middle gear 115, and an M regulated gear 116 and an M carrying engagement gear 117 corresponding to the K middle gear 76, the K regulated gear 81 and the K carrying engagement gear 82 are supported by the M middle gear shaft 43, the M regulated shaft 47 and the M carrying engagement shaft 48, whereby similarly to the K middle transmission system DT1, an M middle transmission system DT3 is constituted. Similarly to the K middle transmission system DT1, the M middle transmission system DT3 is capable of carrying the drive to the agitator 17 of the toner cartridge Km via the regulated gear portion 7 and the drive coupling 9 of the cartridge holder 1*m* or the like, and is capable of carrying the drive to the auger GK2*m* via the M supply gear 118 supported by the M supply gear shaft 46.

At the upper part of the M middle transmission system DT3, an M swing gear 119 that has the same structure as the K swing gear 86 is disposed. Thus, when the YM driving gear 113 of the first embodiment rotates positive, the drive is carried to the M regulated gear 116 via the M middle transmission system DT3, so that the M regulated gear 116 is rotated in the arrow Ye direction, as shown in FIG. 8, and the M swing gear 119 is moved to the M release position and is separated from the M fixing portion 64. Furthermore, after the positive rotation of the YM driving gear 113 is stopped, as shown in FIG. 9, when a force that causes the M regulated gear 116 to rotate in the arrow Yf direction acts, the M swing gear 119 is moved to the M regulation position and is engaged with the M fixing teeth 64*a*, whereby the rotation of the M regulated gear 116 is regulated.

In addition, a Y middle gear 121, a Y relay gear 122, a Y regulated gear 123 and a Y carrying engagement gear 124 corresponding to the C middle gear 89, the C relay gear 93, the C regulated gear 96 and the C carrying engagement gear 97 are supported by the Y middle gear shaft 44, the Y relay shaft 51, the Y regulated shaft 53 and the Y carrying engagement shaft 56, and similarly to the C middle transmission system DT2, a Y middle transmission system DT4 is included.

Similarly to the C middle transmission system DT2, the Y middle transmission system DT4 is capable of carrying the drive to the agitator 17 of the toner cartridge Ky via the driven gear portion 7 and the drive coupling 9 of the cartridge holder 1*y* or the like, and is capable of carrying the drive to the auger GK2*y* via the Y supply gear 126 supported by the Y supply gear shaft 52.

At the upper part of the Y middle transmission system DT4, a Y swing gear 127 that has the same structure as the C swing gear 101 is disposed. Thus, when the YM driving gear 113 of the first embodiment rotates negative, the drive is carried to the Y regulated gear 123 via the Y middle transmission system DT4, so that the Y regulated gear 123 is rotated in the arrow Yg direction as shown in FIG. 9 and the Y swing gear 127 is moved to the Y release position and is separated from the Y fixing portion 66. Furthermore, after the negative rotation of the YM driving gear 113 is stopped, when a force that causes the Y regulated gear 123 to rotate in the arrow Yh direction acts as shown in FIG. 8, the Y swing gear 127 is moved to the Y regulation position and is engaged with the Y fixing teeth 66*a*, whereby the rotation of the Y regulated gear 123 is regulated.

Furthermore, a YM drive system 128 for driving the toner dispensers TDm and TDy corresponding to the CK drive system 104 includes the YM motor unit 111, the YM rolling gear 114, the M middle transmission system DT3 and the Y middle transmission system DT4 or the like.

Furthermore, the respective swing gears 86, 101, 119 and 127 of the first embodiment are formed of resin materials capable of absorbing the impact when contacting the respective fixing portions 62, 63, 64 and 66. In addition, in the first embodiment, as the fixing portion 62, 63, 64 and 66, for example, a non-halogen ABS resin: an acrylonitrile butadiene styrene resin can be used, and as the swing gears 86, 101, 119 and 127, for example, an polyester elastomer having a hardness lower than that of the fixing portions 62, 63, 64 and 66 can be used. The materials, however, not limited thereto, but arbitrary useable materials can be used. In addition, the hardness of the ABS resin or the like can be adjusted by changing the materials to be mixed when molding and the ratios thereof.

In addition, the CK motor unit 67 and the YM motor unit 111 are connected to the control portion C via a cable (not shown) as an example of a connection member.

The control portion C has a powder supply control means C1. The powder supply control means C1 has a consumption amount measuring means C1A, a CK motor unit control means C1B as an example of the drive source control means and a YM motor unit control means C1C. In the powder supply control means C1 of the first embodiment, the respective motor units 67 and 111 are driven for rotation depending on the consumption amount of the measured powder, whereby the supply operations of the respective toner dispensers TDy to TDk are controlled.

The consumption amount measuring means C1A measures the image forming operation, the so-called consumption amount of the powder consumed along with the performance of the job. The consumption amount measuring means C1A of the first embodiment measures the pixel number of the latent image written by the respective latent image forming apparatuses LHy to LHk, the so-called cumulative value of the number of dots for each color and indirectly measures the consumption amount of the powder for each color.

The CK motor unit control means C1B controls the positive and negative rotation driving of the CK motor unit 67. When the K color powder equal to or larger than the predetermined threshold is consumed, the CK motor unit control means C1B of the first embodiment rotates positive the CK motor unit 67 at a time according to the consumption amount to supply the K color powder, based on the measurement result of the consumption amount measuring means C1A. In addition, when the C color powder equal to or larger than the predetermined threshold is consumed, the CK motor unit control means C1B rotates negative the CK motor unit 67 at a time according to the consumption amount to supply the C color powder.

The YM motor unit control means C1C controls the positive and negative rotation drive of the YM motor unit 111. When the M color powder equal to or larger than the predetermined threshold is consumed, the YM motor unit control means C1C of the first embodiment rotates positive the YM motor unit 111 at a time according to the consumption amount to supply the M color powder, based on the measurement result of the consumption amount measuring means C1A. Furthermore, when the Y color powder equal to or larger than the predetermined threshold is consumed, the YM motor unit control means C1C rotates negative the YM motor unit 111 at a time according to the consumption amount to supply the Y color powder.

Operation of First Embodiment

In the image forming apparatus U of the first embodiment including the above-mentioned structure, when the job is performed and each color powder of each developing apparatus Gy to Gk is consumed, depending on the consumption amounts of each color powder, each of the toner dispensers TDy to TDk are operated and each color powder is supplied from each toner cartridge Ky to Kk to each developing apparatus Gy to Gk.

For example, in a case where K color powder is supplied, when the CK motor unit 67 is rotated positive and driven, the CK rolling gear 71 is moved to the K rocking position, and the rolling engagement portion 74 is engaged with the K middle engagement portion 77, whereby the drive is carried to the K middle transmission system DT1.

At this time, as shown in FIG. 8, when the K regulated gear 81, to which the positive rotation drive of the CK motor unit 67 is carried, is rotated in the arrow Ya direction, the K swing gear 86 engaged with the K regulated gear 81 is rotated along the K regulated gear 81 and moved to the K release position. Thus, the K swing engagement portion 88 and the fixing teeth 62*a* are maintained in the non-engagement state, the rotation of the K regulated gear 81 is not blocked off by the K swing gear 86, and the drive is carried to the K carrying engagement gear 82. Accordingly, the drive is carried to the agitator 17 of the toner cartridge Kk and the auger Gk2*k* via the driven gear portion 7 of the cartridge holder 1*k* and the K supply gear 79 or the like, and the K color powder is supplied to the developing apparatus Gk.

The agitator 17 to which the positive rotation drive of the CK motor unit 67 has been carried is driven for rotation in the arrow Yi direction shown in FIG. 5 to carry the powder, but, at this time, the K color powder accommodated in the toner cartridge Kk starts resisting the rotation of the agitator 17.

Furthermore, the agitator 17 of the first embodiment has a shape which is wound in the form of a line from a line material, along with the rotation resistance of the powder, the agitator 17 is subjected to a force twisting in the arrow Yj direction opposite to the arrow Yi direction and thus is elastically deformed.

Furthermore, when the supply of the K color powder to the developing apparatus Gk is finished and the positive rotation drive of the CK motor unit 67 is stopped, so that the drive of the agitator 17 of the toner cartridge Kk and the auger Gk2*k* is stopped, the elastic restoring force of the agitator 17 acts and the agitator 17 is rotated in the arrow Yj direction.

When the rotation of the agitator 17 in the arrow Yj direction is generated, as shown in FIG. 9, the K regulated gear 81 is rotated in the arrow Yb direction, and the K swing gear 86 is rotated along the K regulated gear 81 and is moved from the K release position to the K regulation position. The K swing engagement portion 88 is rotated negative and is engaged with the fixing teeth 62*a*, the K swing gear 86 enters a non-rotatable state, whereby the rotation of the K regulated gear 81 engaged with the K swing gear 86 is regulated.

Figure 12A:
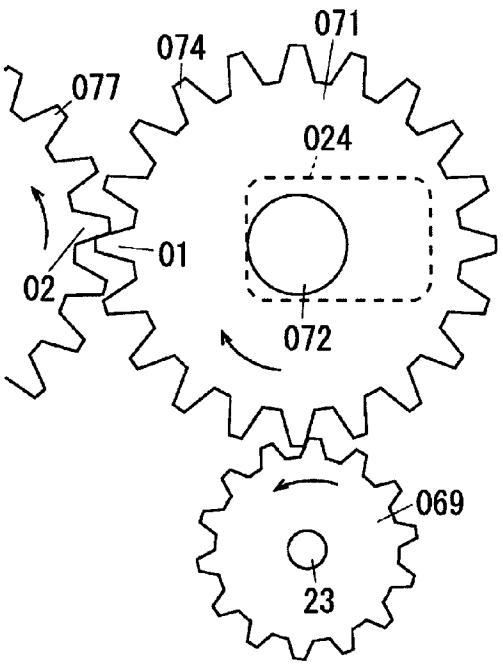
Figure 12B:
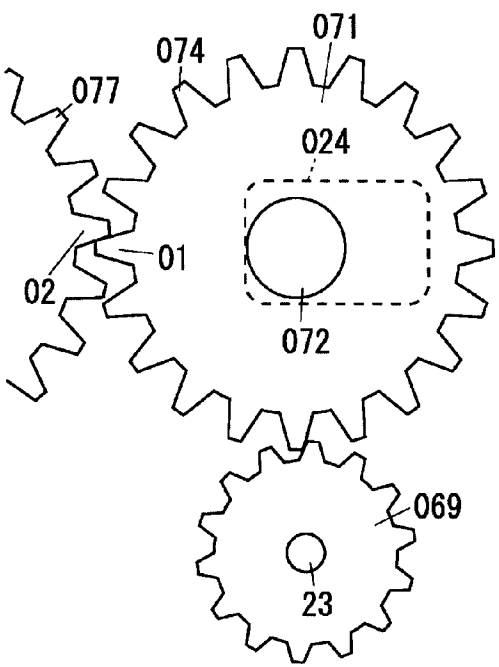
Figure 12C:
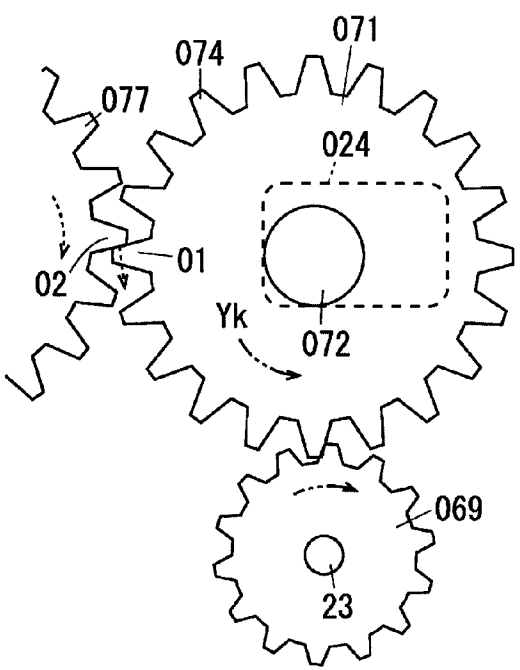

FIG. 12 is a diagram of the principal parts of the drive system of the related art, FIG. 12A is a diagram of a state in which the drive gear is rotated positive, FIG. 12B is a diagram of a state in which the drive gear of FIG. 12A is stopped and FIG. 12C is a diagram of a state in which a force that causes the drive gear to rotate negative due to the elastic restoring force of the agitator acts.

Next, while a structure of the related art which does not have the K swing gear 86 of the first embodiment will be described with reference to FIG. 12, with regard to members having the same structure as the constituents of the first embodiment, reference numerals with 0 added in front of the reference numerals of the first embodiment are used as reference numerals of each constituent in FIG. 12 to facilitate the description and the understanding thereof.

In FIG. 12A, in a state in which a CK rolling gear 071 is moved to the K rocking position, when a CK driving gear 069 is rotated positive and driven, teeth 01 of a rolling engagement portion 074 press teeth 02 of a K middle engagement portion 077, whereby the CK rolling gear 071 is rotated accordingly.

In FIG. 12B, from the state shown in FIG. 12A, when the positive rotation drive of the Ck driving gear 069 is stopped, the rotation of the CK rolling gear 071 is stopped.

In FIG. 12C, from the state shown in FIG. 12B, when a force that causes a K middle gear 076 to rotate negative due to the elastic restoring force of an agitator 017 is applied to the K middle gear 076, the teeth 02 of the K middle engagement portion 077 press the teeth 01 of the rolling engagement portion 074.

Herein, in general, a CK rolling guide hole 024 for rollably supporting the CK rolling gear 071 is formed to have a width in the up and down direction larger than the diameter of the CK rolling shaft 072 and a step is provided between the CK rolling guide hole 024 and the CK rolling shaft 072.

Thus, in the state shown in FIG. 12C, when a reverse rotating force is applied to the K middle gear 76 and the teeth 02 of the K middle engagement portion 77 press the teeth 01 of the rolling engagement portion 074, the CK rolling gear 071 is subjected to a force in a direction that is pressed to the CK driving gear 069. Accordingly, the CK rolling gear 071 is engaged with the CK driving gear 069 and the engagement of the CK driving gear 069 and the rolling engagement portion 074 becomes deep.

There was a concern that, in this state, even when the CK driving gear 069 is rotated negative and driven, the rotation of the engaged CK rolling gear 071 would be disturbed and the rotation of the CK driving gear 069 would not be smoothly performed, and, as a result, the CK rolling gear 071 would not roll.

In addition, in FIG. 12C, when, with respect to the K middle gear 076, a force that negative rotates the K middle gear 076 by the elastic restoring force of the agitator 017 acts, the teeth 02 of the K middle engagement portion 077 continues to press the teeth 01 of the rolling engagement portion 074. Furthermore, there was a concern that in this state, even when the CK driving gear 069 is rotated negative and driven and a force that tries to cause the CK rolling gear 071 to roll acts, the teeth 01 of the rolling engagement portion 074 would press the teeth 02 of the K middle engagement portion 077 and the rolling of the CK rolling gear 071 would be disturbed, and thus the CK rolling gear 071 would not roll.

Furthermore, in the state shown in FIG. 12B, the K middle gear 076 produces a force that causes the CK rolling gear 071 to rotate in the arrow Yk direction. Thus, there was a concern that even when the CK driving gear 069 is rotated negative and driven, the rolling gear 071 would not roll and would press to the K middle gear 076 and the CK rolling gear 071 would rotate in the arrow Yk direction, whereby the rolling start of the Ck rolling gear 071 would be delayed.

Thus, there was a concern that from the state shown in FIG. 12B, even when the CK driving gear 069 is rotated negative and driven, the time when the CK rolling gear 071 is engaged with the C middle gear 089 would be delayed, and as a result, the supply amount of the C color powder would be decreased.

On the other hand, in the image forming apparatus U of the first embodiment, even when the elastic restoring force acts against the twisting of the agitator 17, the K swing gear 86 engaged with the K regulated gear 81 is moved to the K regulation position and is engaged with the K fixing teeth 62*a*, and the rotation of the K regulated gear 81 in the arrow Yb direction is regulated, whereby the carrying of the elastic restoring force of the agitator 17 to the K middle gear 76 is suppressed.

Thus, as compared to the structure of the related art in which the rotation due to the elastic restoring force relative to the twisting of the agitator 17 is carried to the K middle gear 76, in the image forming apparatus U of the first embodiment, when the C color powder is supplied after the K color powder is supplied, the delay of the time when the CK rolling gear 071 is engaged with the C middle gear 089 is decreased.

Furthermore, each of the middle transmission systems DT2 to DT4 of Y, M and C colors also has the same structure as that of the K color middle transmission system DT1, whereby the carrying of the rotation due to the elastic restoring force of the twisting of each agitator 17 is suppressed.

In the first embodiment, by combining each fixing portion 62 to 66 with each swing gear 86, 101, 119 and 127, the disturbance of the rolling of each rolling gear 71 and 114 is suppressed, which results in lower cost as compared to the case of using the one way clutch.

In addition, in the first embodiment, each securing member 62 to 66 is integrally formed in the gear unit plate 22 formed of the resin material and each of the swing gears 86, 101, 119 and 127 is formed of the resin material, whereby the production costs such as the material cost and the working cost are suppressed as compared to the case of using the metallic components.

Additionally, when each of the swing gears 86, 101, 119 and 127 comes in contact with each of the fixing teeth 62*a* to 66*a*, an impact sound may be generated. In particular, each of the swing gears 86, 101, 119 and 127 of the first embodiment is engaged with each of the fixing teeth 62*a* to 66*a* to regulate the rotations of each of the regulated gears 81, 96, 116 and 123, whereby the loads applied to each of the swing gears 86, 101, 119 and 127 easily increase and the impact sound is also easily generated. In regard to this, in each of the swing gears 86, 101, 119 and 127 of the first embodiment, the resin material capable of absorbing the impact is used, whereby the impact sound generated by the contact of each of the swing gears 86, 101, 119 and 127 and each of the fixing teeth 62*a* to 66*a* is reduced as compared to a structure that does not use the resin material capable of absorbing the impact.

Figure 13A:
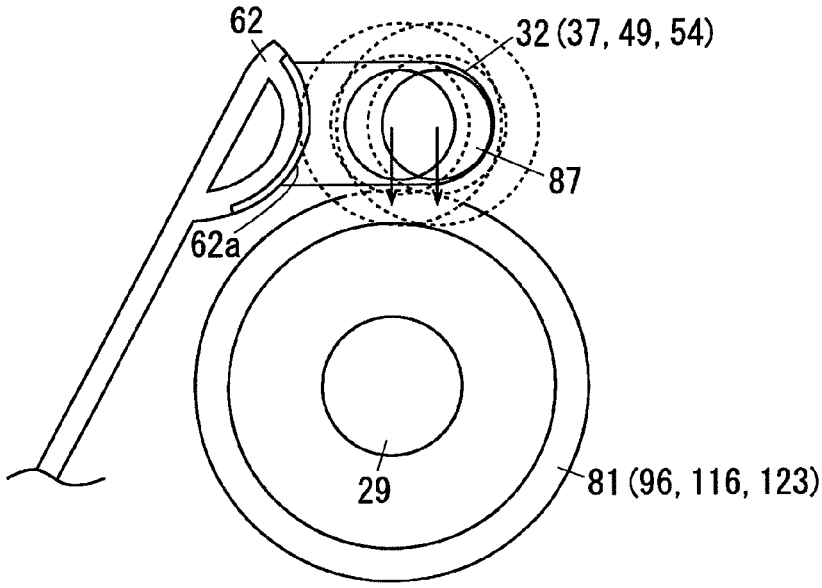
Figure 13B:
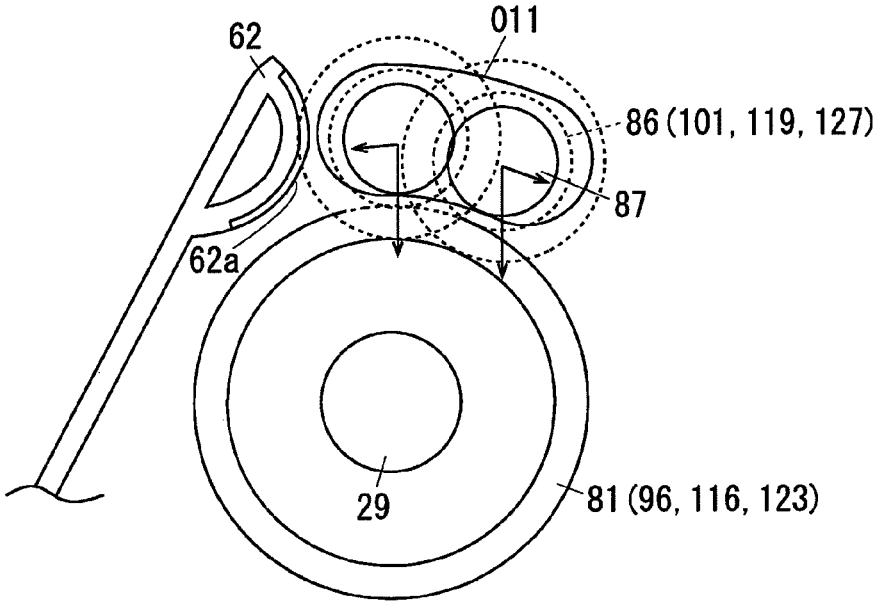

FIG. 13 is a diagram of the principal parts of a regulation guide portion, FIG. 13A is a diagram of a first regulation guide portion of the first embodiment, and FIG. 13B is a diagram of the principal parts of an arched regulation guide portion with a convex upper part.

In FIGS. 7 and 13A, each of the swing guide holes 32, 37, 49 and 54, which rotatably supports each swing shaft of each of the swing gears 86, 101, 119 and 127 of the first embodiment, extends in the horizontal direction and each of the swing gears 86, 101, 119 and 127 is movable between the regulation position and the release position that are set at the same height.

In FIG. 13B, as the swing guide hole, the structure that uses the arched swing guide hole 011 with the convex upper part is also considered. When the arched swing guide hole 011 with the convex upper part is used, in the state in which each of the swing gears 86, 101, 119 and 127 is moved to the regulation position and the release position shown in FIG. 13B by the dotted lines, there is a concern that due to the influence of the gravitational force acting on each of the swing gears 86, 101, 119 and 127, each of the swing gears 86, 101, 119 and 127 will be moved to the left and right ends of the swing guide hole and deviate from the regulation position or the like. In the state, there is a concern that each of the swing gears 86, 101, 119 and 127 will be engaged with each of the fixing teeth 62*a* to 66*a* and each of the regulated gears 81, 96, 116 and 123.

On the other hand, in the long hole-shaped swing guide holes 32, 37, 49 and 54 extending in the left and right direction of the first embodiment, due to the influence of the gravitational force acting on each of the swing gears 86, 101, 119 and 127, each of the swing gears 86, 101, 119 and 127 hardly deviates from the regulation position or the like. Thus, as compared to the case of using the arched swing guide hole 011 with the convex upper part, the swing gears 86, 101, 119 and 127 of the first embodiment are stably maintained at the regulation position or the like. Accordingly, the engagement of each of the swing arm 86, 101, 119 and 127 with each of the fixing teeth 62*a* to 66*a* and each of the regulated gears 81, 96, 116 and 123 is reduced, whereby the regulations of the movements of each of the swing gears 86, 101, 119 and 127 and the rotations of each of the regulated gears 81, 96, 116 and 123 are reduced.

Figure 14A:
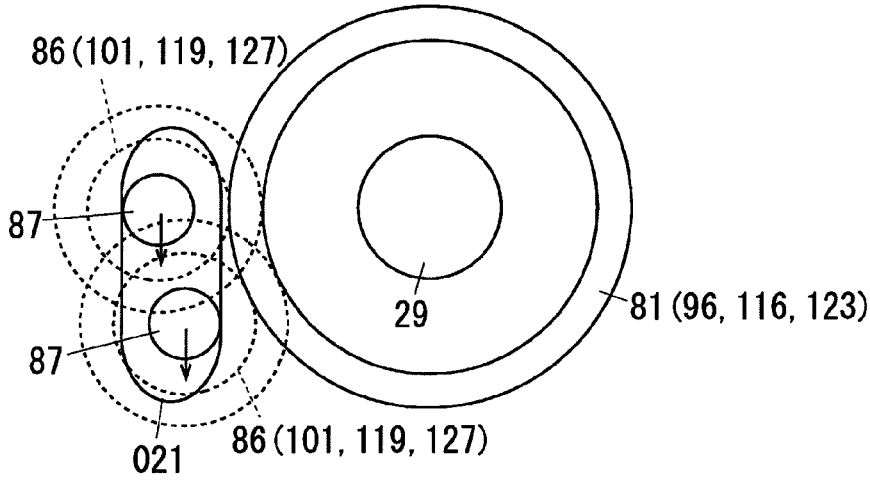
Figure 14B:
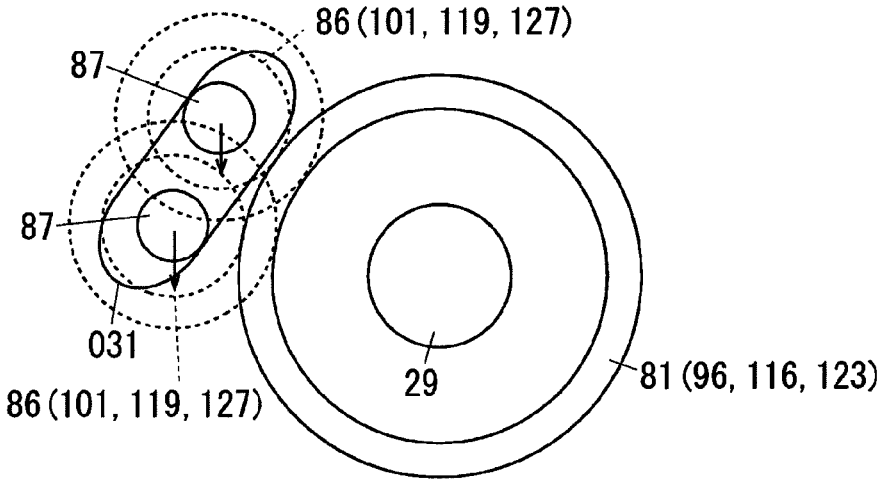

FIG. 14 is a diagram of the principal parts of the regulation guide portion. FIG. 14A is a diagram of the principal parts of a regulation guide portion with a long hole shape in the up and down direction, and FIG. 14B is a diagram of the principal parts of an inclined regulation guide portion.

Furthermore, as the swing guide hole, a structure that uses a long hole-shaped swing guide hole 021 extending in the up and down direction shown in FIG. 14A and an inclined swing guide hole 031 shown in FIG. 14B is also considered.

However, if the swing guide hole 021 extending in the up and down direction and the inclined swing guide hole 031 are used, when the swing gears 86, 101, 119 and 127 are moved to the upper position shown in FIGS. 14A and 14B by the dotted lines, due to the self weight of the swing gears 86, 101, 119 and 127, a force in a direction pressing against the regulated gears 81, 96, 116 and 123 acts on the swing gears 86, 101, 119 and 127. Accordingly, the swing gears 86, 101, 119 and 127 are easily engaged with the regulated gears 81, 96, 116 and 123, whereby the engagement of the swing gears 86, 101, 119 and 127 and the regulated gears 81, 96, 116 and 123 is easily deepened.

On the other hand, when the swing gears 86, 101, 119 and 127 are moved to the lower position shown by a dotted and solid line in FIGS. 14A and 14B, the self weights of the swing gears 86, 101, 119 and 127 do not act as a force in a direction that presses the swing gears 86, 101, 119 and 127 to the regulated gears 81, 96, 116 and 123. Thus, as compared to the case where the swing gears 86, 101, 119 and 127 are moved to the upper position, the engagement of the swing gears 86, 101, 119 and 127 and the regulated gears 81, 96, 116 and 123 easily becomes shallow.

Accordingly, in the swing guide hole 021 extending in the up and down direction and the inclined swing guide hole 031, irregularity is easily generated in the depth of the engagement of the swing gears 86, 101, 119 and 127 and the regulated gears 81, 96, 116 and 123.

On the other hand, in the swing guide holes 32, 37, 49 and 54 with the long hole shape extending in the left and right direction of the first embodiment, the regulation position is set to be the same height as the release position and the swing gears 86, 101, 119 and 127 are moved in the horizontal direction.

Thus, as compared to the case where the swing guide hole is formed in the up and down direction and obliquely, the swing gears 86, 101, 119 and 127 and the regulated gears 81, 96, 116 and 123 are easily engaged with each other at a predetermined engagement depth, whereby occurrence of the irregularity in the engagement depth between the swing gears 86, 101, 119 and 127 and the regulated gears 81, 96, 116 and 123 is reduced.

Figure 15A:
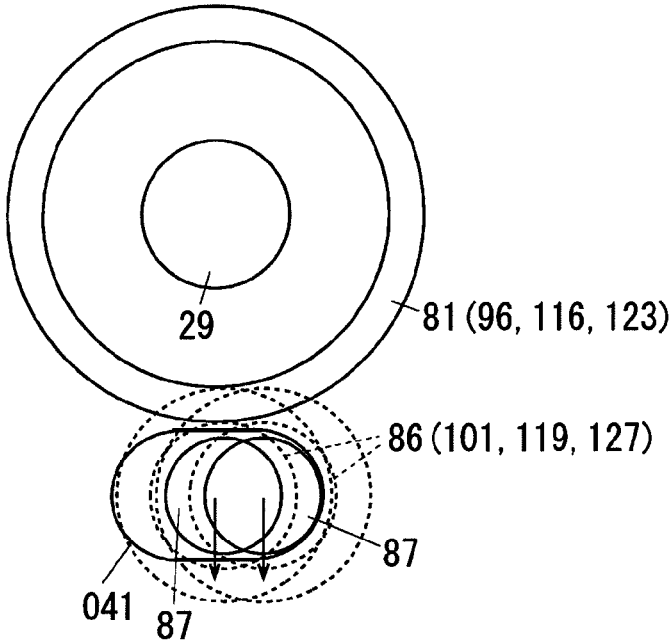
Figure 15B:
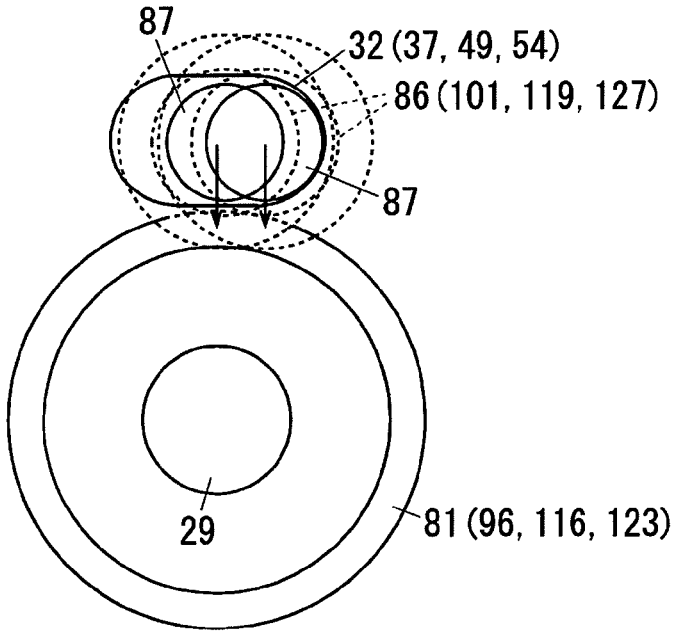

FIG. 15 is a diagram of the principal parts of the regulation guide portion. FIG. 15A is a diagram of the principal parts of the regulation guide portion disposed at the lower part of the regulated gear, and FIG. 15B is a diagram of the principal parts of a first regulation guide portion of the first embodiment.

In a structure in which a swing guide hole 041 is disposed at the lower part of the regulated gears 81, 96, 116 and 123 shown in FIG. 15A, the self weights of the swing gears 86, 101, 119 and 127 do not act as a force in a direction that presses the swing gears 86, 101, 119 and 127 to the regulated gears 81, 96, 116 and 123.

Thus, when there is unsteadiness and a margin of tolerance in the dimensions or the like, there is a danger that the engagement of the swing gears 86, 101, 119 and 127 and the regulated gears 81, 96, 116 and 123 will easily become shallow and irregularity may be generated in the carrying of the rotation.

On the other hand, in the structure in which the swing guide holes 32, 37, 49 and 54 are disposed at the upper part of the regulated gears 81, 96, 116 and 123 of the first embodiment shown in FIG. 15B, due to the self weights of the swing gears 86, 101, 119 and 127, a force in a direction pressing against the regulated gears 81, 96, 116 and 123 acts on the swing gears 86, 101, 119 and 127.

Thus, as compared to the structure in which the swing guide hole 041 is disposed at the lower part of the regulated gears 81, 96, 116 and 123, the engagement of the swing gears 86, 101, 119 and 127 and the regulated gears 81, 96, 116 and 123 do not easily become shallow, and the engagement of the swing gears 86, 101, 119 and 127 and the regulated gears 81, 96, 116 and 123 are easily set to a predetermined engagement amount.

Thus, the poor movements of the swing gears 86, 101, 119 and 127 are reduced and the supply irregularity generated when each color powder is supplied is reduced.

The regulated gears 81, 96, 116 and 123 of the first embodiment are set to have diameters and gear teeth numbers smaller than those of the middle gears 79, 89, 115 and 121. Thus, in the structure of the first embodiment in which the swing gears 86, 101, 119 and 127 are engaged with the regulated gears 81, 96, 116 and 123, as compared to the structure in which the swing gears 86, 101, 119 and 127 are engaged with the middle gears 79, 89, 115 and 121, the torques from each agitator 17 are small and the forces received by the swing gears 86, 101, 119 and 127 become small. Thus, the impact when the swing gears 86, 101, 119 and 127 collide with the fixing teeth 62*a* to 66*a* becomes small.

Figure 16:
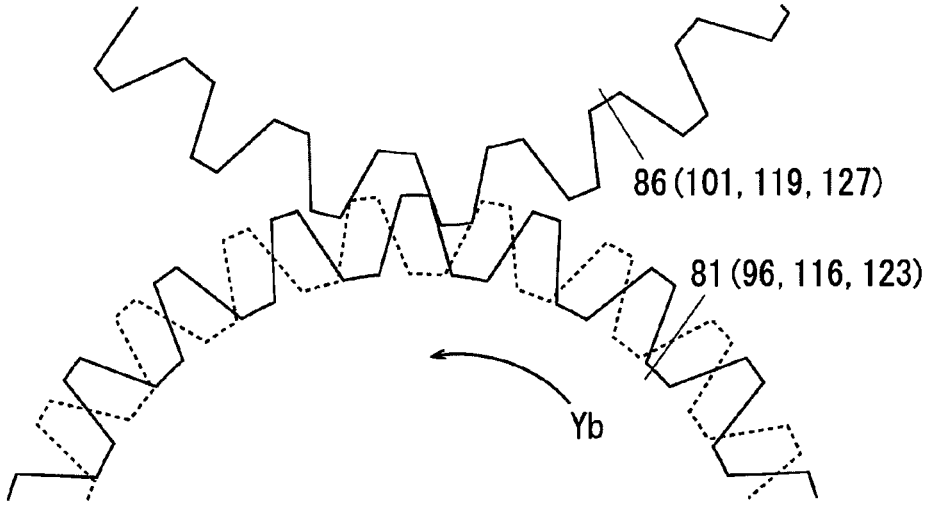
FIG. 16 is a diagram of a state in which a negative rotation from a powder carrying member is carried to a regulated gear of the first embodiment.

FIG. 16 is a diagram of a state in which the negative rotation from the powder carrying member is carried to the regulated gear of the first embodiment.

In addition, the drive systems 104 and 128 of the first embodiment are constituted by five gears of the driving gears 69 and 113, the rolling gears 71 and 114, the middle gears 76, 89, 115 and 121, the regulated gears 81, 96, 116 and 123, and the carrying engagement gears 82, 97, 117 and 124.

Furthermore, the swing gears 86, 101, 119 and 127 are engaged with the fourth gear, that is, the regulated gears 81, 96, 116 and 123 disposed at the second stage from the agitator 17 side.

When the negative rotation from the agitator 17 is carried, in an engaging region between the gears of the gear train, depending on the production error of the gear teeth, a very small gap may be generated between the teeth and the carrying of the negative rotation may be delayed to the extent that the teeth are slightly elastically deformed, whereby the carrying of the negative rotation of the agitator 17 is delayed by as much as the gear separated from the agitator 17.

At this time, in the swing gears 86, 101, 119 and 127 of the first embodiment, as shown in FIG. 16, after the regulated gears 81, 96, 116 and 123 are rotated negative until the teeth of the regulated gears 81, 96, 116 and 123 come in contact with the teeth of the swing gears 86, 101, 119 and 127, when the regulated gears 81, 96, 116 and 123 are not rotated negative until the swing gears 86, 101, 119 and 127 are engaged with the fixing teeth 62*a* to 66*a*, the carrying of the negative rotations of the regulated gears 81, 96, 116 and 123 is not regulated.

Herein, when the swing gears 86, 101, 119 and 127 are engaged with the gears separated from the agitator 17 side, that is, the gears near the rolling gears 71 and 114, there is a concern that before the swing gears 86, 101, 119 and 127 are engaged with the fixing gear 62*a* to 66*a*, the negative rotation is carried, a force disturbing the rolling acts on the rolling gears 71 and 114. In regard to this, as in the first embodiment, when the swing gears 86, 101, 119 and 127 are engaged with the gears near the agitator 17, the negative rotation is regulated in the vicinity of the agitator 17 and the carrying of the rotation to the rolling gears 71 and 114 sides is effectively regulated, whereby the rolling of the rolling gears 71 and 114 are hardly disturbed and the stable supply of each color powder is performed.

Modified Example

As described hereinabove, although the embodiments of the present invention have been specifically described, the present invention is not limited to the embodiments but can be variously modified within the scope of the gist of the present invention described in the claims. Modified examples (H01) to (H10) of the present invention will be described hereinafter.

(H01) while the image forming apparatus U has been described in the above-mentioned embodiment, the present invention is not limited thereto but can be applied to a copier, a FAX or a multi-function apparatus having plural of functions or the like. Furthermore, the present invention is not limited to image forming apparatus of four color development but can be applied to image forming apparatuses of two colors, three colors or five colors or more.

(H02) While in the above-mentioned embodiment, the structure has been described in which when the motor units 67 and 111 are rotated positive and driven, the powder of the K and M colors are supplied and when the motor units 67 and 111 are rotated negative and driven, the powder of the C and Y colors are supplied, the present invention is not limited thereto but a structure is also possible in which when the motor units 67 and 111 are rotated positive and driven, the powder of the C and Y colors are supplied and when the motor units 67 and 111 are rotated negative and driven, the powder of the K and M colors are supplied.

(H03) While in the above-mentioned embodiment, the powder of the C color and the K color have been supplied by one motor unit and the powder of the Y color and M color has been supplied by one motor unit, the present invention is not limited thereto, but the combination of the supplied colors can be arbitrarily modified depending on the design. For example, in addition, a combination is also possible in which the powder of the Y color and the K color are supplied by an independent motor, respectively and the powder of the M color and the C color are supplied by the motor unit described in the embodiment. That is, the number of the rolling gear may be one.

(H04) While in the above-mentioned embodiment, the structure has been described in which the resin material capable of absorbing the impact when colliding with the fixing teeth 62*a* to 66*a* is used for the swing gears 86, 101, 119 and 127 corresponding to the fixing teeth 62*a* to 66*a*, the present invention is not limited thereto, but a structure in which the resin material capable of absorbing the impact is used for the fixing teeth 62*a* to 66*a* and both the fixing teeth 62*a* to 66*a* and the swing gears 86, 101, 119 and 127 is also possible.

In addition, while it is desirable that the resin capable of absorbing the impact be used, a material having a low ability to absorb the impact may be also used.

(H05) While in the above-mentioned embodiment, as the drive systems 104 and 128 for driving the toner dispensers TDy to TDk, the structure that uses the five gears or six gears has been described, the present invention is not limited thereto, but the number and the arrangement of the gears can be arbitrarily changed and a structure that uses the four gears or less or seven gears or more is also possible.

(H06) While in the above-mentioned embodiment, the structure in which the plane gear is used for the gear train of the drive systems 104 and 128 has been described, the present invention is not limited thereto, but a structure in which gears other than the plane gear, for example, an inclined gear and a bevel gear or the like are used for the gear train is also possible.

(H07) While in the above-mentioned embodiment, it is desirable that the swing guide holes 32, 37, 49 and 54 have the long hole shapes extending in the left and right direction, they may also have certain shapes capable of guiding the swing gears 86, 101, 119 and 127 having arched shapes or the like. In addition, the swing guide holes 32, 37, 49 and 54 could also have shapes extending in the up and down direction and the inclined direction. Namely, the movement directions of the swing gears 86, 101, 119 and 127 need not be the horizontal direction. Similarly, the rolling gears 71 and 114 are also not limited to the structure moving in the horizontal direction, but a direction other than the horizontal direction is also possible.

(H08) While in the above-mentioned embodiment, the structure in which the swing gears 86, 101, 119 and 127 are disposed at the upper part of the regulated gears 81, 96, 116 and 123 is desirable, a structure in which the swing gears 86, 101, 119 and 127 are disposed at the lower part and the front part of the regulated gears 81, 96, 116 and 123 and in the inclined direction is also possible.

Furthermore, depending on the arrangements of the swing gears 86, 101, 119 and 127, the positions of the fixing portions 62 to 66 can also be changed.

(H09) While in the above-mentioned embodiment, the structure has been described in which the swing gears 86, 101, 119 and 127 are engaged with the regulated gears 81, 96, 116 and 123 disposed at the second gear from the agitator 17 side, the present invention is not limited thereto, but a structure in which the swing gears 86, 101, 119 and 127 are engaged with gears other than the regulated gears 81, 96, 116 and 123 is also possible.

Furthermore, as the gears with which the swing gears 86, 101, 119 and 127 are engaged, it is desirable that the gears be at the stage situated as close as possible to the agitator 17 and receive as little torque as possible.

(H10) While in the above-mentioned embodiment, the agitator 17 having the shape that is wound from the line material has been described, the present invention is not limited thereto, but known carrying members of the related art that carrying the powder toward the supply opening can also be used.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder carrying apparatus comprising:

a driving gear to which the drive is carried from a drive source capable of rotating positive and negative;

a rocking gear capable of rotating around a rolling shaft which is movably supported along a rocking guide portion installed in a frame, wherein the rocking gear is engaged with the driving gear, when the drive source rotates positive, the rocking gear is moved to a prescribed first rocking position along the rocking guide portion, and when the drive source rotates negative, the rocking gear is moved to a second rocking position different from the first rocking position along the rocking guide portion;

a first intermediate transmission system having at least one or more gears including a first intermediate gear engaged with the rocking gear that has been moved to the first rocking position;

a first powder carrying member to which the rotation is carried from the first intermediate transmission system to carrying the powder;

a first regulating gear capable of rotating around a first regulating shaft which is movably supported along a first regulating guide portion installed in the frame, wherein when the drive source rotates positive, the first regulating gear is moved to a first release position separated from the first fixing teeth installed in the frame, and when a force in a direction in which the drive source rotates negative acts on the first powder carrying member, the first regulating gear is moved to a first regulating position in which the first regulating gear is engaged with the first fixing teeth to regulate the rotation of the first intermediate gear;

a second intermediate transmission system having at least one or more gears including a second intermediate gear engaged with the rocking gear that has been moved to the second rocking position;

a second powder carrying member to which the rotation is carried from the second intermediate transmission system to carry the powder; and a second regulating gear capable of rotating around a second regulating shaft which is movably supported along a second regulating guide portion installed in the frame, wherein when the drive source rotates negative, the second regulating gear is moved to a second release position separated from the second fixing teeth installed in the frame, and when a force in a direction in which the drive source rotates positive acts on the second powder carrying member, the second regulating gear is moved to a second regulating position in which the second regulating gear is engaged with the second fixing teeth to regulate the rotation of the second intermediate gear.

2. The powder carrying apparatus according to claim 1, further comprising:

a first middle transmission system having a first regulated gear engaged with the first regulating gear;

the first regulating gear disposed in an upper part of a gravitational direction of the first regulated gear;

the first fixing teeth disposed in a side part of a horizontal direction of the first regulating gear;

the second middle transmission system having a second regulated gear engaged with the second regulating gear;

the second regulating gear disposed in an upper part of a gravitational direction of the second regulated gear; and the second fixing teeth disposed in a side part of a horizontal direction of the second regulating gear.

3. The powder carrying apparatus according to claim 1, further comprising:

at least one of the first regulating gear and the first fixing teeth formed of a shock absorbing material that absorbs shock at the time of contact of the first regulating gear and the first fixing teeth when the first regulating gear is moved from the first release position to the first regulation position; and at least one of the second regulating gear and the second fixing teeth formed of a shock absorbing material that absorbs shock at the time of contact of the second regulating gear and the second fixing teeth when the second regulating gear is moved from the second release position to the second regulation position.

4. The powder carrying apparatus according to claim 1, further comprising:

a first carrying gear that transmits the rotation to the first powder carrying member;

the first middle transmission system which is engaged with the first carrying gear and has a first carrying engagement gear engaged with the first regulated gear;

a second carrying gear that transmits the rotation to the second powder carrying member; and the second middle transmission system which is engaged with the second carrying gear and has a second carrying engagement gear engaged with the second regulated gear, and one or more gears that are disposed between the second regulated gear and the second middle gear and carry the rotation between the second regulated gear and the second middle gear.

5. An image forming apparatus comprising:

a first image holder with a first latent image formed on a front surface thereof;

a second image holder with a second latent image formed on a front surface thereof;

a first developing apparatus that develops a first latent image on the front surface of the first image holder to a visible image;

a second developing apparatus that develops a second latent image on the front surface of the second image holder to a visible image; and a powder carrying apparatus according to claim 1 that transports the powder to the first developing apparatus and the second developing apparatus.

6. The powder carrying apparatus according to claim 5, further comprising:

a first middle transmission system having a first regulated gear engaged with the first regulating gear;

the first regulating gear disposed in an upper part of a gravitational direction of the first regulated gear;

the first fixing teeth disposed in a side part of a horizontal direction of the first regulating gear;

the second middle transmission system having a second regulated gear engaged with the second regulating gear;

the second regulating gear disposed in an upper part of a gravitational direction of the second regulated gear; and the second fixing teeth disposed in a side part of a horizontal direction of the second regulating gear.

7. The powder carrying apparatus according to claim 5, further comprising:

at least one of the first regulating gear and the first fixing teeth formed of a shock absorbing material that absorbs shock at the time of contact of the first regulating gear and the first fixing teeth when the first regulating gear is moved from the first release position to the first regulation position; and at least one of the second regulating gear and the second fixing teeth formed of a shock absorbing material that absorbs shock at the time of contact of the second regulating gear and the second fixing teeth when the second regulating gear is moved from the second release position to the second regulation position.

8. The powder carrying apparatus according to claim 5, further comprising:

a first carrying gear that transmits the rotation to the first powder carrying member;

the first middle transmission system which is engaged with the first carrying gear and has a first carrying engagement gear engaged with the first regulated gear;

a second carrying gear that transmits the rotation to the second powder carrying member; and the second middle transmission system which is engaged with the second carrying gear and has a second carrying engagement gear engaged with the second regulated gear, and one or more gears that are disposed between the second regulated gear and the second middle gear and carry the rotation between the second regulated gear and the second middle gear.

* * * * *